US005694517A

United States Patent [19]

Sugino et al.

[11] Patent Number: 5,694,517

[45] Date of Patent: Dec. 2, 1997

[54] SIGNAL DISCRIMINATION CIRCUIT FOR DETERMINING THE TYPE OF SIGNAL TRANSMITTED VIA A TELEPHONE NETWORK

[75] Inventors: Yukimasa Sugino; Yushi Naito, both of Kanagawa, Japan

[73] Assignee: Mitsubishi Denki Kabushiki Kaisha, Tokyo, Japan

[21] Appl. No.: 481,056

[22] Filed: Jun. 7, 1995

[30] Foreign Application Priority Data

Mar. 24, 1995 [JP] Japan ..... 7-066268

[51] Int. Cl.[6] ..... G10L 9/12

[52] U.S. Cl. ..... 395/2.17; 395/2.22; 395/2.23; 395/2.36; 395/2.42; 379/20

[58] Field of Search ..... 395/2.12, 2.14, 395/2.17, 2.22, 2.23, 2.36, 2.42; 379/98, 351, 6, 88, 80, 97, 100, 283; 358/434, 436, 438, 468

[56] References Cited

U.S. PATENT DOCUMENTS

| | | | |
|---|---|---|---|
| 4,979,211 | 12/1990 | Benvenuto et al. . | |
| 4,979,214 | 12/1990 | Hamilton . | |
| 4,980,917 | 12/1990 | Hutchins . | |
| 5,023,906 | 6/1991 | Novas . | |
| 5,159,638 | 10/1992 | Naito et al. | 395/2.22 |
| 5,164,980 | 11/1992 | Bush et al. . | |
| 5,255,311 | 10/1993 | Yoshida . | |
| 5,295,223 | 3/1994 | Saito et al. . | |
| 5,315,704 | 5/1994 | Shinta et al. . | |
| 5,325,425 | 6/1994 | Novas et al. . | |
| 5,581,651 | 12/1996 | Ishino et al. | 395/2.37 |

FOREIGN PATENT DOCUMENTS 3-250961 11/1991 Japan .

6-022073 1/1994 Japan .

OTHER PUBLICATIONS

"A DSP Implemented Speech/Voicedband Data Discrimination" pp. 1419–1427: Authors: S. Casale, C. Giarrizzo and A. La Corte.

"Highly Sensitive Speech Detector and High–Speed Voiceband Data Discriminator in DSI–ADPCM Systems", pp. 739–751; Author: Yohtaro Yatsuzuka.

*Primary Examiner*—David D. Knepper
*Assistant Examiner*—Alphonso A. Collins
*Attorney, Agent, or Firm*—Wolf, Greenfield & Sacks, P.C.

[57] ABSTRACT

A signal discrimination circuit for discriminating between a voice signal and a voiceband data signal that is transmitted over a telephone network. The signal discrimination circuit includes an electric power judgement unit, a zero-crossing number judgement unit, a sub-band power calculation unit, a tone detection unit, and a discriminated result output unit. The electric power judgement unit determines whether an input signal is a voice signal or a voiceband data signal based on an interblock electric power ratio of the input signal. The zero-crossing number judgement unit determines whether the input signal is a voice signal or a voiceband data signal based on a zero-crossing number of the input signal. The sub-band power calculation unit analyzes the input signal with a spectrum analyzer to generate a spectrum analyzed result and calculates sub-band powers using the spectrum analyzed result, and the tone detection unit determines a presence and absence of a tone signal based on the sub-band powers calculated by the sub-band power calculation unit. Based on determined results of the electric power judgement unit, the zero-crossing number judgement unit, and the tone detection unit, the discriminated result output unit determines whether the input signal is a voice signal or a voiceband data signal and outputs a judged result.

21 Claims, 22 Drawing Sheets

S1
LINEAR CONVERSION UNIT
1
S2
S3
S4
ZERO-CROSSING NUMBER JUDGEMENT UNIT
3
ELECTRIC POWER JUDGEMENT UNIT
2
S5
S6
DISCRIMINATED RESULT OUTPUT UNIT
56
S11
S10
S7
FFT CALCULATION UNIT
50
S8-0
S8-1
S8-2
S8-(n-2)
S8-(n-1)
SUB-BAND POWER CALCULATION UNIT
51
S9-0
S9-1
S9-2
S9-(n-2)
S9-(n-1)
TONE DETECTION UNIT
55
S17

SIGNAL DISCRIMINATION CIRCUIT FOR DETERMINING THE TYPE OF SIGNAL TRANSMITTED VIA A TELEPHONE NETWORK

BACKGROUND OF THE INVENTION

This invention relates to a signal discrimination circuit and, more particularly to a signal discrimination circuit for discriminating the type of a signal transmitted via a telephone network to a voice signal and a voiceband data signal, for example.

A digital circuit multiplication equipment (simply referred to hereinafter as a "DCME") has heretofore been known as an apparatus to which this signal discrimination circuit is applied. FIG. 21 shows in block form an overall arrangement of the DCME. As shown in FIG. 21, in the DCME, there are shown M-channel input signals 200-1 through 200-M which are input to the DCME. The M-channel input signals 200-1 to 200-M are input through signal lines 201-1 to 201-M, 202-1 to 202-M, 203-1 to 203-M to channel assignment unit 210, an activity detection unit 211 and a signal discrimination unit 212, respectively. The activity detection unit 211 determines whether the M-channel input signals 200-1 to 200-M are held in the active state or in the silent state. Then, the activity detection unit 211 supplies detected results to the channel assignment unit 210 as active/silent judged results 204-1 to 204-M.

The channel assignment unit 210 is responsive to the active/silent judged results 204-1 to 204-M to assign the signal of the active channel of the M-channel input signals 200-1 to 200-M to any of m signal lines 206-1 to 206-m and sends the same to an encoding unit 213. The signal discrimination unit 212 determines whether the M-channel input signals 200-1 to 200-M are the voice signal or the voiceband data signal. Then, the signal discrimination unit 212 outputs the judged results to the encoding unit 213 as signal type discriminated results 205-1 to 205-M. The encoding unit 213 encodes the m-channel input signals 206-1 to 206-m supplied thereto from the channel assignment unit 210 at a proper encoding bit rate corresponding to the signal type based on the signal type discriminated results 205-1 to 205-M supplied thereto from the signal discrimination unit 212 to thereby output encoded signals 207-1 to 207-m.

In a conversational speech signal such as a telephone communication signal, it is known that a silent time during which the each subscriber listens to a speech of the person he is talking to occupies about 60% to 70% of the whole telephone communication time. Therefore, if the channel assignment unit 210 connects only the active speech channel signals among the M-channel input signals 200-1 to 200-M to the m-channel signal lines (m is smaller than M), then the channel assignment unit 210 can reduce the transmission channels. Also, the encoding unit 213 encodes the input signals 206-1 to 206-m in a low-rate encoding fashion. As the encoding algorithm used by the encoding unit 213, there is known an adaptive differential pulse code modulation (simply referred to hereinafter as "ADPCM") system described in ITU-T recommendation G.726. According to the ADPCM system, an input signal with a transmission rate of 64 [kbits/s] can be compressed and encoded to any one of signals with transmission rates of 40 [kbits/s], 32 [kbits/s], 24 [kbits/s] and 16 [kbits/s].

If the encoding unit 213 uses the ADPCM system, then a encoding bit rate should preferably be selected on the basis of judged result obtained when it is determined whether the input signal is the voice signal or the voiceband data signal. Specifically, when the input signal is the voice signal, if an encoding bit rate is lowered in a range in which a quality of an voice signal can be maintained without disturbing a telephone conversation, then a telephone network can be utilized more efficiently. Thus, in this case, the encoding bit rate is chosen to be 32 [kbits/s] or lower. When on the other hand the input signal is the voiceband data signal, the encoding bit rate has to be chosen to be 40 [kbits/s] in order to avoid the occurrence of a transmission error. As described above, the signal discrimination unit 212 that can determine whether the input signal is the voice signal or the voiceband data signal is required in order to properly determine the encoding bit rate of the encoding unit 213. Therefore, the encoding speed of the encoding unit 213 may be controlled in response to the signal type discriminated results 205-1 to 205-M of the signal discrimination unit 212. FIG. 22 shows a conventional signal discrimination circuit (see Unexamined Japanese Patent Publication (Kokai) 3-250961). This signal discrimination circuit is made corresponding to a one-channel input signal input to the DCME and can discriminate the signal type of the one-channel input signal. As shown in FIG. 22, there is provided a linear conversion unit 1 for converting an input PCM signal S1 to a linearly quantized PCM signal S2 after the input PCM signal S1 had been nonlinearly quantized by a suitable coding method, such as A-low compression and encoding. In FIG. 22, reference numeral 2 denotes an electric power judgement unit, 3 a zero-crossing number judgement unit and 6 an AND circuit. With the above-mentioned arrangement, the nonlinearly quantized PCM signal S1 input to the signal discrimination circuit is converted to the linearly quantized PCM signal S2 by the linear conversion unit 1 and input through signal lines S3, S4 to the electric power judgement unit 2 and the zero-crossing number judgement unit 3, respectively.

The electric power judgement unit 2 calculates an electric power ratio between predetermined blocks with respect to the linearly quantized PCM signal S2 input thereto (referred to hereinafter as "interblock electric power ratio"). Then, the electric power judgement unit 2 judges on the basis of a magnitude of the interblock electric power ratio whether the input signal S2 is the voice signal or the voiceband data signal. The electric power judgement unit 2 supplies a judged result to the AND circuit 6 as an output S5. FIGS. 23A to 23C show waveforms of various input signals input to the signal discrimination circuit. A fluctuation of a signal level of a voiceband data signal (FIG. 23B) is smaller than that of an voice signal (FIG. 23A). Accordingly, when the interblock electric power ratio is larger than a predetermined threshold value, the electric power judgement unit 2 determines that the input signal S2 is the voice signal. Then, the electric power judgement unit 2 sets its output S5 to a value "0". When the interblock electric power ratio is smaller than the threshold value, the electric power judgement unit 2 determines that the input signal S2 is the voiceband data signal. Then, the electric power judgement unit 2 sets its output S5 to a value "1".

The zero-crossing number judgement unit 3 receives the input linearly quantized PCM signal S2 and calculates the number (simply referred to hereinafter as "zero-crossing number") with which the linearly quantized PCM signal S2 crosses the zero level during the unit time. Then, the zero-crossing number judgement unit 3 determines on the basis of the magnitude of the zero-crossing number whether the input signal S2 is the voice signal or the voiceband data signal. The zero-crossing number judgement unit 3 supplies its judged result to the AND circuit 6 as an output S6. FIGS. 24A to 24C show frequencies at which the various input signals input to the signal discrimination circuit cross the zero level. A distribution of a zero-crossing number of the voiceband data signal (FIG. 24B) is narrower than that of the voice signal (FIG. 24A). Since the distribution of the zero-crossing numbers of the voiceband data signal is limited to a particular range dependent on a modulation system of a MODEM (modulator and demodulator), if the conditions that the fluctuation of the zero-crossing number is small and that the zero-crossing number falls within a constant range are satisfied, then the zero-crossing number judgement unit 3 determines that the input signal is the voiceband data signal. Then, the zero-crossing number judgement unit 3 sets its output to the value "1". If not, then the zero-crossing number judgement unit 3 judges that the input signal is the voice signal. Then, the zero-crossing number judgement unit 3 sets its output to the value "0".

The AND circuit 6 performs the calculation of logical AND of the output S5 of the electric power judgement unit 2 and the output S6 of the zero-crossing number judgement unit 3. Then, the AND circuit 6 supplies a judged result indicative of whether the input signal is the voice signal or the voiceband data signal as an output S12. The following table 1 shows a truth table indicating the states of the signals input to and output from the AND circuit 6.

TABLE 1

| | | | | |
|---|---|---|---|---|
| Output (S5) of electric power judgement unit 2 | 0 | 0 | 1 | 1 |
| Output (S6) of zero-crossing number judgement unit 3 | 0 | 1 | 0 | 1 |
| Output (S12) of AND circuit 6 | 0 | 0 | 0 | 1 |

Study of the table 1 reveals that, when the output S5 of the electric power judgement unit 2 and the output S6 of the zero-crossing number judgement unit 3 are both held at the value "1", it is determined that the input signal is the voiceband data signal. Then, the output S12 of the AND circuit 6 is set to the value "1". Also, when at least one of the output S5 of the electric power judgement unit 2 and the output S6 of the zero-crossing number judgement unit 3 is held at the value "0", it is determined that the input signal is the voice signal. Then, the output S12 of the AND circuit 6 is set to the value "0". The output S12 of the AND circuit 6 becomes the judged result of the signal discrimination circuit.

Therefore, when the voiceband data signal is input to the signal discrimination circuit, the electric power judgement unit 2 and the zero-crossing number judgement unit 3 determine that the input signal is the voiceband data signal. Then, if the outputs S5, S6 thereof are set to the value "1" and the AND circuit 6 performs the calculation of the logical AND of the output S5 of the electric power judgement unit 2 and the output S6 of the zero-crossing number judgement unit 6, then the output S12 of the signal discrimination circuit is set to the value "1" (voiceband data signal). When on the other hand the voice signal is input to the signal discrimination circuit, the electric power judgement unit 2 determines that the input signal is the voice signal. Then, the electric power judgement unit 2 sets its output S5 to the value "0". Alternatively, the zero-crossing number judgement unit 3 determines that the input signal is the voice signal. Then, the zero-crossing number judgement unit 3 sets its output S6 to the value "0". If the AND circuit 6 performs the calculation of the logical AND of the output S5 of the electric power judgement unit 2 and the output S6 of the zero-crossing number judgement unit 3, then the output S12 of the signal discrimination circuit is set to the value "0" (voice signal).

In the above-mentioned DCME, it is frequently observed that a test is made by using an input tone signal in order to evaluate a quality of a telephone network used when a telecommunication based on the voice signal is carried out. In this case, in order to obtain the proper encoding bit rate used when the voice signal is input, it is desirable that the signal discrimination circuit should determine that the input tone signal is the voice signal.

The following table 2 shows output states of the conventional signal discrimination circuit when the voice signal, the voiceband data signal and the tone signal are input to the signal discrimination circuit as a variety of input signals.

TABLE 2

| Type of input signal | Output of signal discrimination circuit |
|---|---|
| Voice signal | 0 (voice signal) |
| Tone signal | 1 (voiceband data signal) |
| Voiceband data signal | 1 (voiceband data signal) |

The conventional signal discrimination circuit outputs a discriminated result of value "0" (voice signal) when the input signal has a large fluctuation of zero-crossing number. Moreover, the conventional signal discrimination circuit outputs a discriminated result of value "1" (voiceband data signal) when the input signal has a small fluctuation of zero-crossing number and a fluctuation of an electric power is small.

A fluctuation of a signal level of the tone signal is much smaller than those of signal levels of the voiceband data signal (FIG. 23B) and the voice signal (FIG. 23A) as shown in FIG. 23C. Also, a distribution of the zero-crossing number of the tone signal is much narrower than those of the zero-crossing numbers of the voiceband data signal (FIG. 24B) and the voice signal (FIG. 24A) as shown in FIG. 24C. Therefore, the aforesaid conventional signal discrimination circuit is difficult to discriminate between the voiceband data signal and the tone signal from each other. Accordingly, if the tone signal is input to the conventional signal discrimination circuit, there is then the problem that a signal identified result is erroneously identified as the value "1" (voiceband data signal).

SUMMARY OF THE INVENTION

In view of the aforesaid aspect, the present invention is to provide a signal discrimination circuit which can reliably classify various types of signals including tone signal into voice signal or voiceband data signal with a high accuracy.

In order to solve the aforesaid problems, a signal discrimination circuit according to a first aspect of the invention includes an electric power judgement unit for determining on the basis of an interblock electric power ratio whether an input signal is a voice signal or a voiceband data signal, a zero-crossing number judgement unit for determining on the basis of the number of zero-crossings whether the input signal is the voice signal or the voiceband data signal, and a discriminated result output unit for determining on the basis of the judged results of the electric power judgement unit and the zero-crossing number judgement unit whether the input signal is the voice signal or the voiceband data signal and outputting a judged result. This inventive signal discrimination circuit further includes a sub-band power calculation unit for calculating powers of each frequency bands by using analyzed results after having analyzed an input signal by a spectrum analyzer and a tone detection unit for determining on the basis of an output of the sub-band power calculation unit whether or not there exists a tone signal, wherein an operation of the discriminated result output unit is controlled by an output of the tone detection unit.

A signal discrimination circuit according to a second aspect of the invention includes a sub-band power calculation unit for calculating powers of each frequency bands by using analyzed results after having analyzed an input signal by a spectrum analyzer, a tone detection unit for determining on the basis of an output of the sub-band power calculation unit whether or not there exists a tone signal, an voice/data discrimination unit for determining on the basis of an output from the sub-band power calculation unit and a discriminated result output unit for determining on the basis of judged results of the tone detection unit and the voice/data discrimination unit whether an input signal is the voice signal or the voiceband data signal and outputting a judged result.

Furthermore, a signal discrimination circuit according to the invention includes a reset signal generation unit for receiving a signalling signal, detecting a connection or a disconnection of call on the basis of the state of the signalling signal and generating a reset signal when a call connection or a call disconnection is detected. When the reset signal generation unit generates the reset signal, the signal discrimination circuit outputs the discriminated state of the voice signal.

Furthermore, a signal discrimination circuit according to the invention includes a tone detection unit to compare a power value of the frequency band closest to 2100 [Hz] of the outputs of the sub-band power calculation unit with a predetermined threshold value. Then, the tone detection unit detects the presence or absence of the tone signal with the frequency of 2100 [Hz] on the basis of the compared result. When the tone detection unit detects the tone signal with frequency of 2100 [Hz], the signal discrimination circuit outputs the discriminated state of the voiceband data signal. Furthermore, a signal discrimination circuit according to the invention includes a tone detection unit composed of a peak frequency power addition unit for adding a power value of the maximum power band of the outputs of the sub-band power calculation unit and power values of N bands adjacent to the foregoing band, a whole band power addition unit for adding power values of whole frequency band output from the sub-band power calculation unit and a judgement unit for calculating a ratio between an output of the peak frequency power addition unit and an output of the whole band power addition unit and judging the presence or absence of the tone signal on the basis of the calculated result.

Furthermore, a signal discrimination circuit according to the invention includes a tone detection unit composed of a first peak frequency power addition unit for adding a power value of the maximum power band of the outputs of the sub-band power calculation unit and power values of N bands adjacent to the foregoing band, a peak frequency power zero mask unit for forcibly setting an added output of the band supplied thereto from the first peak frequency power addition unit to a value "0" after outputs of the sub-band power calculation unit had been added by the first peak frequency power addition unit, a second peak frequency power addition unit for adding a power value of the maximum power band of the outputs of the peak frequency power zero mask unit and power values of N bands adjacent to the foregoing band, an adder for adding an output of the first peak frequency power addition unit and an output of the second peak frequency power addition unit, a whole band power addition unit for adding whole band power values output from the sub-band power calculation unit, and a judgement unit for calculating a ratio between an output of the adder and an output of the whole band power addition unit and judging the presence or absence of the tone signal on the basis of a calculated result.

Furthermore, a signal discrimination circuit according to the invention includes a tone detection unit composed of center frequency calculation unit for calculating a mean value of a frequency spectrum distribution of an input signal from the output of the sub-band power calculation unit, a delay buffer for holding an output of the center frequency calculation unit and a judgement unit for judging the presence or absence of a tone signal on the basis of the output of the center frequency calculation unit and an output of the delay buffer.

Furthermore, a signal discrimination circuit according to the invention includes a tone detection unit composed of a delay buffer for holding an output of the sub-band power calculation unit, a difference calculation unit for calculating a difference between the output of the sub-band power calculation unit and an output of the delay buffer, and a judgement unit for judging the presence or absence of a tone signal on the basis of an output from the difference calculation unit.

Furthermore, a signal discrimination circuit according to the invention includes a tone detection unit composed of a delay buffer for holding an output of the sub-band power calculation unit, a divider for calculating a ratio between the output of the sub-band power calculation unit and an output of the delay buffer, and a judgement unit for judging the presence or absence of a tone signal on the basis of an output from the divider.

Furthermore, a signal discrimination circuit according to the invention includes an voice/data discrimination unit composed of a low frequency power addition unit for adding only power values of the lower frequency bands of outputs from the sub-band power calculation unit, a whole band power addition unit for adding whole band power values output from the sub-band power calculation unit, and a judgement unit for calculating a ratio between an output of the low frequency power addition unit and output of the whole band power addition unit and judging on the basis of a calculated result whether an input signal is a voice signal or a voiceband data signal.

Furthermore, a signal discrimination circuit according to the invention includes the voice/data discrimination unit composed of a whole band power addition unit for adding whole band power values output from the sub-band power calculation unit, a delay buffer for holding an output of the whole band power addition unit, a difference calculation unit for calculating a difference between the output of the whole band power addition unit and an output of the delay buffer, and a judgement unit for judging on the basis of an output from the difference calculation unit whether an input signal is a voice signal or a voiceband data signal.

Furthermore, a signal discrimination circuit according to the invention includes the voice/data discrimination unit composed of a low frequency power addition unit for adding only power values of low frequency bands of outputs from the sub-band power calculation unit, a whole band power addition unit for adding whole band power values output from the sub-band power calculation unit, a delay buffer for holding an output of the whole band power addition unit, a difference calculation unit for calculating a difference between the output of the whole band power addition unit and an output of the delay buffer, and a judgement unit for determining on the basis of outputs of the low frequency power addition unit, the whole band power addition unit and the difference calculation unit whether an input signal is a voice signal or a voiceband data signal.

Furthermore, a signal discrimination circuit according to the invention includes the voice/data discrimination unit composed of a sub-band power decimation unit for selecting from an output of the sub-band power calculation unit a plurality of bands in which features of a voice signal or a voiceband data signal become conspicuous and a judgement unit for judging on the basis of an output of the sub-band power decimation unit whether an input signal is a voice signal or a voiceband data signal.

According to the present invention, an operation of the discriminated result output unit for determining on the basis of the judged result based on the interblock electric power ratio of the input signal and the judged result of the zero-crossing number whether the input signal is the voice signal or the voiceband data signal is controlled by the output from the tone detection unit for calculating the sub-band power by analyzing the input signal from a spectrum standpoint and which determines the presence or absence of the tone signal on the basis of the calculated sub-band power. Therefore, the tone signal can be reliably classified into the voice signal. Thus, it is possible to reliably classify various types of signals including tone signal into voice signal or voiceband data signal with high accuracy.

According to other aspect of the present invention, the sub-band power is calculated by analyzing the input signal from a spectrum standpoint. Then, the presence or absence of the tone signal is judged on the basis of the calculated sub-band power. Also, it is determined on the basis of the calculated sub-band power whether the input signal is the voice signal or the voiceband data signal. Then, it is determined on the basis of the tone detection result and the voice/data discriminated result whether the input signal is the voice signal or the voiceband data signal. Therefore, when the voice signal and the voiceband data signal are discriminated from each other, it is possible to reliably classify various types of signals including tone signal into voice signal or voiceband data signal with a high accuracy by the arrangement in which the decisions based on the interblock electric power ratio and the zero crossing number are not carried out.

Further, it is determined on the basis of the state of the signalling signal whether the call is connected or the call is disconnected. When the call connection or the call disconnection is detected, the reset signal is generated and the signal discrimination circuit outputs the discriminated state of the voice signal in response to the reset signal. Therefore, when a telephone communication is started, the signal discrimination circuit can output the initial signal discriminated output of the voice signal. Thus, it is possible to reliably classify various types of signals including tone signal into voice signal or voiceband data signal with a high accuracy.

Further, when the tone signal is detected, the presence or absence of the 2100 [Hz] tone signal is detected in response to the power value of the band close to 2100 [Hz] of the sub-band powers. Then, when the 2100 [Hz] tone signal is detected, the signal discrimination circuit outputs the discriminated state of the voiceband data signal. Therefore, the 2100 [Hz] tone signal used as the MODEM communication procedure can reliably be classified into the voiceband data signal. Thus, it is possible to reliably classify various types of signals including tone signal into voice signal or voiceband data signal with a high accuracy.

Further, when the tone signal is detected, the presence or absence of the tone signal is judged in response to the added value which results from adding the power value of the maximum power value band of the sub-band powers and the power value of the nearby band and the added value which results from adding the whole band power values of the sub-band powers. Therefore, it is possible to reliably detect the tone signal with a single frequency by using a characteristic in which a ratio between the added value of the peak powers and the added value of the whole band powers is increased when the input signal in which a frequency spectrum is concentrated locally is supplied. Thus, it is possible to reliably classify various types of signals including tone signal into voice signal or voice band data signal with a high accuracy.

When the tone signal is detected, the first peak power is obtained by adding the power value of the maximum band of the sub-band power and the power value of the nearby band. Also, the second peak power is obtained by adding the power value of the maximum band of other sub-band powers and the power value of the nearby band. Then, the presence or absence of the tone signal is detected in response to the ratio between the added value which results from adding these power values and the added value which results from adding the whole band power values of the sub-band powers. Therefore, when the input signal with a frequency spectrum locally concentrated, such as the tone signal with the single frequency or the tone signal with dual frequencies is supplied, it is possible to reliably detect such input signal by using a characteristic in which the ratio between the added value of the peak powers and the added value of the whole band powers is increased. Thus, it is possible to reliably classify various types of signals including tone signal into voice signal or voiceband data signal with a high accuracy.

When the tone signal is detected, the mean value of the frequency spectrum distribution of the input signal is calculated from the sub-band powers as the center frequency. Also, the center frequency is held and the presence or absence of the tone signal is judged on the basis of the center frequency. Therefore, when input signals with small fluctuation of frequency spectrum, such as the tone signal with the single frequency or the tone signal with dual frequencies are supplied, it is possible to reliably detect these input signals by using a characteristic in which the time fluctuation of the center frequency is reduced. Thus, it is possible to reliably classify various types of signals including tone signal into voice signal or voiceband data signal with a high accuracy.

When the tone signal is detected, the sub-band powers are held and the presence or absence of the tone signal is judged on the basis of the difference between the sub-band powers thus held and sub-band powers directly inputted. Therefore, when the input signal with a small frequency spectrum fluctuation, such as a single-frequency tone signal or a dual-frequency tone signal is supplied, it is possible to detect the tone signal with the single frequency or the tone signal with the dual frequencies by using a characteristic in which the difference is reduced. Thus, it is possible to reliably classify various types of signals including tone signal into voice signal or voiceband data signal with a high accuracy.

Further, when the tone signal is detected, sub-band powers are held and the presence or absence of the tone signal is judged on the basis of the ratio between the sub-band powers thus held and sub-band powers directly inputted. Therefore, when the input signals with the small frequency spectrum fluctuation, such as a single-frequency tone signal or a dual-frequency tone signal are supplied, it is possible to detect the tone signal with the single frequency or the tone signal with the dual frequencies by using a characteristic in which the ratio is reduced. Thus, it is possible to reliably classify various types of signals including tone signal into voice signal or voiceband data signal with a high accuracy.

Further, it is determined on the basis of the ratio between the output which results from adding only the power values of the low frequency bands of the sub-band powers and the output which results from adding the whole band power values of the sub-band powers whether the input signal is the voice signal or the voiceband data signal. Therefore, it is possible to discriminate between the voice signal and the voiceband data signal by using a characteristic in which the ratio of the output which results from adding only the power values of the low frequency bands relative to the output which results from adding the power values of the whole band is increased when the input signal in which the power distribution is deviated in the low frequency band, such as the voice signal is supplied.

Further, in the voice/data discrimination unit, the sub-band powers of the whole bands are added and the added output is held. Then, it is determined on the basis of the difference between the added value thus held and the added value which results from directly adding the sub-band powers of the whole bands whether the input signal is the voice signal or the voiceband data signal. Therefore, the difference is increased when the input signal with the large time fluctuation of power, such as the voice signal is supplied. Thus, it is possible to discriminate between the voice signal and the voiceband data signal by comparing the output of this difference calculation unit with a certain threshold value.

Further, the voice/data discrimination unit calculates the added value which results from adding only the sub-band powers of the low frequency band and the added value which results from adding the whole band powers of the sub-band powers. Then, the added value which results from the whole band power values is held and a difference between the added value thus held and the added value which results from directly adding the whole band power values is calculated. Then, it is determined on the basis of the difference between the added value of the power values of the low frequency band and the added value of the whole band power values whether or not the input signal is the voice signal or the voiceband data signal. Therefore, it is possible to highly accurately discriminate between the voice signal and the voiceband data signal by using the characteristic in which the ratio of the added value of the power values of the low frequency band relative to the added value of the whole band power values is increased when the input signal in which the power distribution is deviated on the low frequency band such as the voice signal is supplied and the characteristic in which the difference is increased when the input signal with the large time fluctuation of power such as the voice signal is supplied.

Furthermore, the voice/data discrimination unit selects a plurality of bands in which features of the voice signal or the voiceband data signal of the sub-band powers become remarkably conspicuous and decimates bands to output the power value. Then, it is determined on the basis of this output whether the input signal is the voice signal or the voiceband data signal. Therefore, if the voice/data discrimination processing is executed by using each of bands typically representing a low frequency band, a middle frequency band and a high frequency band of the sub-band powers, then it is possible to discriminate between the voice signal and the voiceband data signal by the simple arrangement with a high accuracy.

DETAILED DESCRIPTION OF PREFERRED EMBODIMENTS

Embodiments of the present invention will hereinafter be described with reference to the drawings.

Embodiment 1

Figure 1:
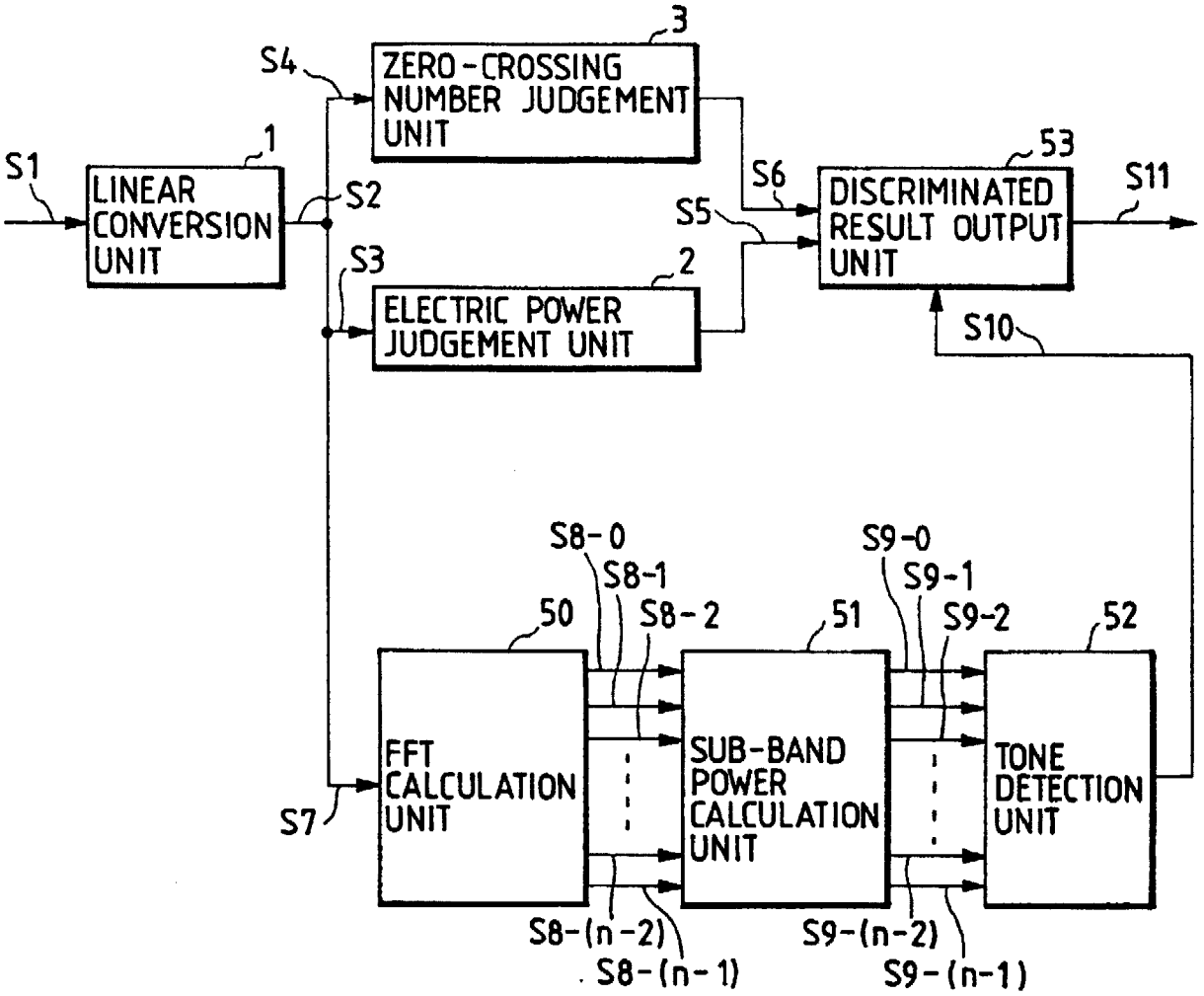
FIG. 1 is a block diagram showing an arrangement of a signal discrimination circuit according to an embodiment 1.
Figure 22:
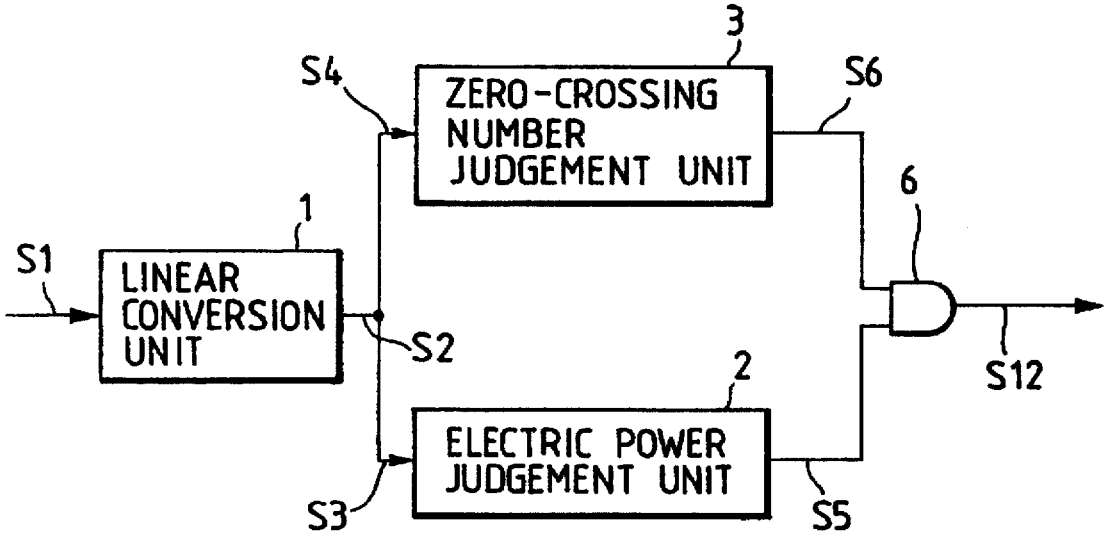
FIG. 22 (PRIOR ART)
FIG. 22 is a block diagram showing an arrangement of a conventional signal discrimination circuit.
Figure 23A:
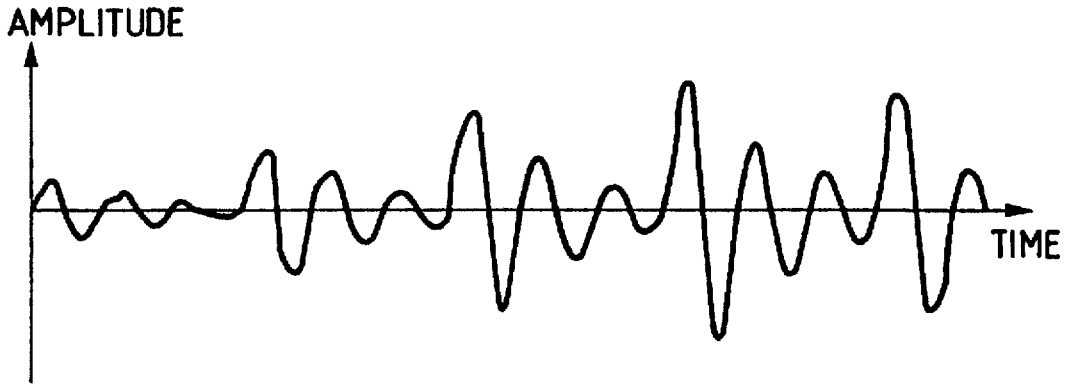
FIGS. 23A to 23C are signal waveform diagrams used to explain waveforms of various signals input to the signal discrimination circuit of the present invention.
Figure 23B:
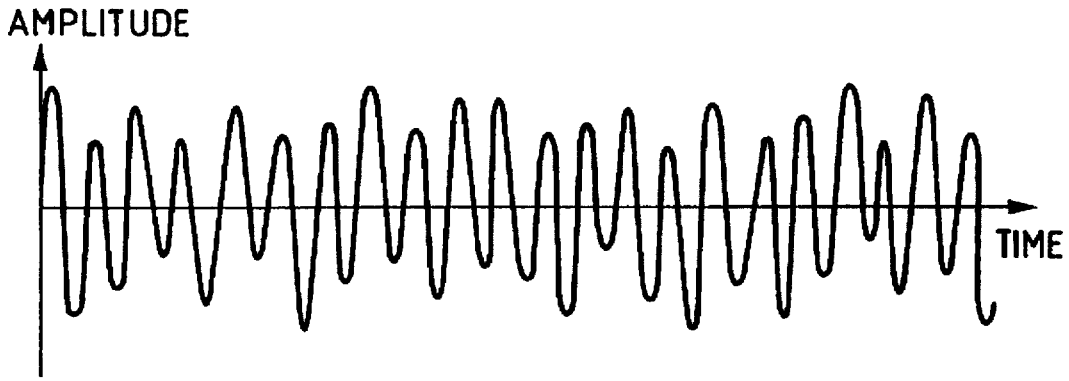
Figure 23C:
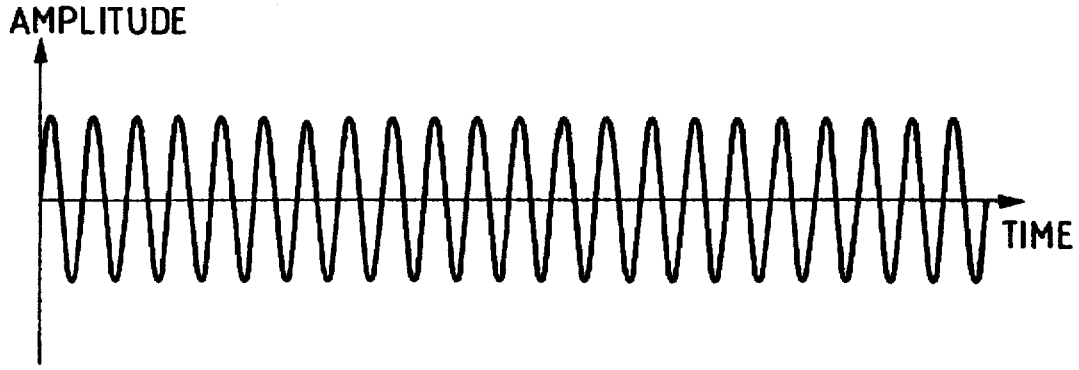
Figure 24A:
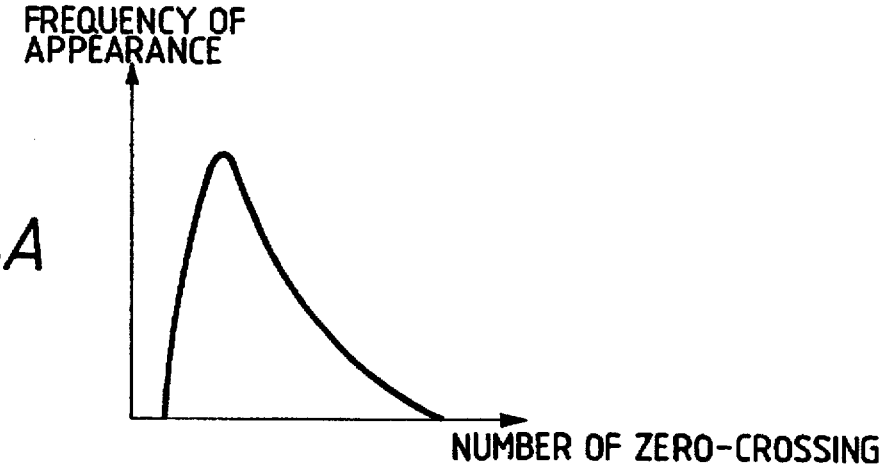
FIGS. 24A to 24C are schematic diagrams used to explain a frequency at which various signals input to the signal discrimination circuit cross the zero level.
Figure 24B:
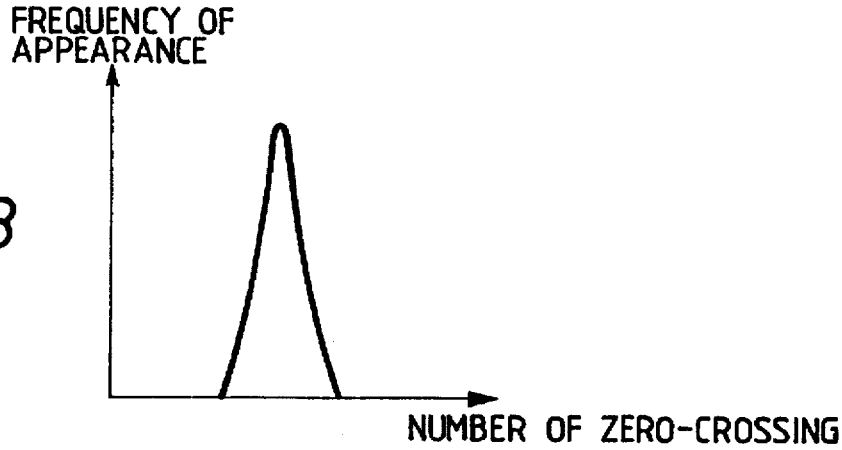
Figure 24C:
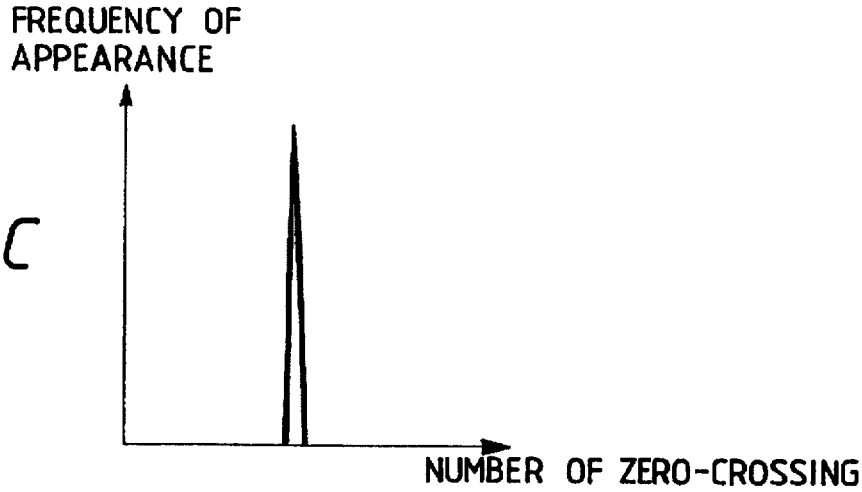

FIG. 1 shows an arrangement of an embodiment 1 of a signal discrimination circuit. In FIG. 1, like parts corresponding to those of FIG. 22 are marked with the same references. As shown in FIG. 1, there is provided a FFT calculation unit 50 which effects a FFT (fast Fourier transform) calculation on the output S2 input thereto from the linear conversion unit 1 through a signal line S7. A sub-band power calculation unit 51 receives outputs S8-0 to S8-(n−1) from the FFT calculation unit 50 and calculates powers of every signal band. A tone detection unit 52 receives output S9-0 to S9-(n−1) from the sub-band power calculation unit 51 and judges the presence or absence of the tone signal on the basis of the sub-band powers. A discriminated result output unit 53 determines on the basis of the output S5 of the electric power judgement unit 2, the output S6 of the zero-crossing number judgement unit 3 and the output S10 of the tone detection unit 52 whether the input signal S1 is the voice signal or the voiceband data signal.

Figure 2:
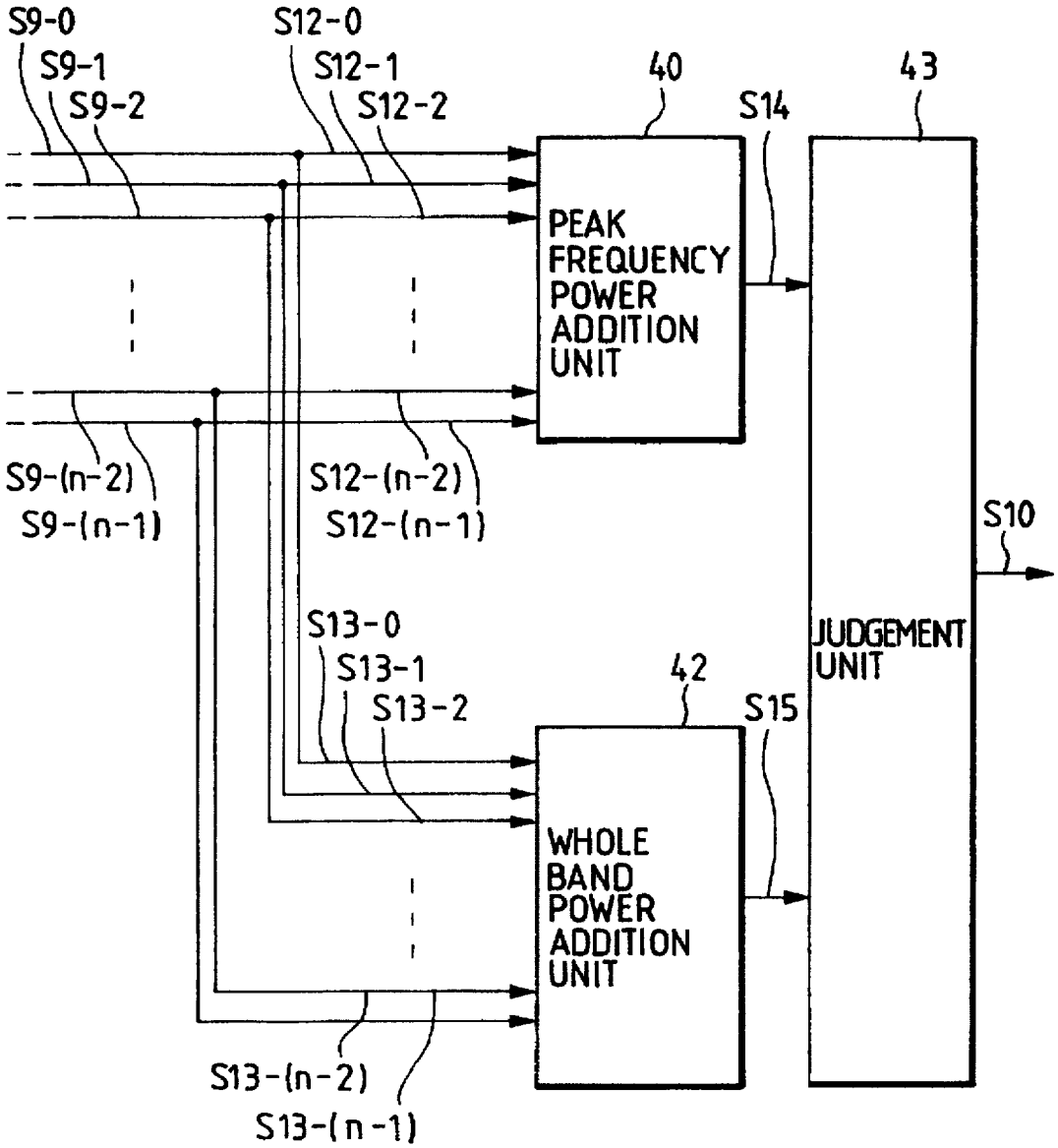
FIG. 2 is a block diagram showing an arrangement of a tone detection unit in the signal discrimination circuit shown in FIG. 1.

FIG. 2 shows an arrangement of the tone detection unit 52 in detail. As shown in FIG. 2, there is provided a peak frequency power addition unit 40 for receiving the output S9-0 to S9-(n−1) input thereto from the sub-band power calculation unit 51 through signal lines S12-0 to S12-(n−1) and which adds a power value of the maximum power band and power values of N bands adjacent to the maximum power band. Moreover, there is shown a whole band power addition unit 42 which adds all outputs S9-0 to S9-(n−1) input thereto from the sub-band power calculation unit 51 through signal lines S13-0 to S13-(n−1) to calculate the powers of the whole frequency bands. Furthermore, there is shown a judgement unit 43 for calculating a ratio between an output S14 of the peak frequency power addition unit 40 and an output S15 of the whole band power addition unit 42 and which judges the presence or absence of the tone signal on the basis of the value of this ratio.

With the aforesaid arrangement, the output S2 from the linear conversion unit 1 is input through the signal lines S3, S4, S7 to the electric power judgement unit 2, the zero-crossing number judgement unit 3 and the FFT calculation unit 50. The FFT calculation unit 50 receives the output S2 input thereto from the linear conversion unit 1 through the signal line S7 and sets consecutive 2n linear PCM signal sample strings to one analysis frame. Then, the FFT calculation unit 50 multiplies signals existing within this analysis frame with a window function and effects a discrete Fourier transform on the signals multiplied with the window function. Then, the FFT calculation unit 50 transmits calculated results as the outputs S8-0 to S8-(n−1).

In this case, x[0], x[1], . . . , x[2n−1] assume the linear PCM signal sample strings input to the FFT calculation unit 50. As the window function that are multiplied to the linear PCM signal sample strings, there is known a Humming window which is defined by the following equation (1):

$$w[k]=0.54-0.46\cos(2\pi k/2n) \tag{1}$$

where k=0, 1, 2, . . . , 2n−1

The resulting signal which results from multiplying the linear PCM signal sample strings with the window function of the equation (1) is represented by y[k] and expressed by the following equation (2):

$$y[k]=x[k]\times w[k] \tag{2}$$

where k=0, 1, 2, . . . , 2n−1

Subsequently, the signal y[k] multiplied with the window function is processed by a discrete Fourier transform defined by the following equation (3):

$$X[k]=\sum_{m=0}^{2n-1} y[m]w^{km} \tag{3}$$

where $w=e^{-j2\pi/2n}$ k=0, 1, 2, . . . , 2n−1

Then, the calculated results X[0], X[1], X[2], . . . , X[n−2], X[n−1] are set to the output S8-0, S8-1, S8-2, . . . , S8-(n−2), S8-(n−1) of the FFT calculation unit 50, respectively. As the calculating means of this discrete Fourier transform, there can be used a FFT (fast Fourier transform), for example.

Then, the sub-band power calculation unit 51 calculates powers of n bands on the basis of the outputs S8-0 to S8-(n−1) of the FFT calculation unit 50 and transmits the calculated results as the outputs S9-0 to S9-(n−1). Assuming that P[0], P[1], P[2], . . . , P[n−2], P[n−1] are the powers S9-0, S9-1, S9-2, . . . , S9-(n−2), S9-(n−1) of the bands output from the sub-band power calculation unit 51, then P[0] to P[n−1] can be obtained by effecting a calculation expressed by the following equation (4) on X[0] to X[n−1]:

$$P[k]=X[k]\times X^*[k] \tag{4}$$

where k=0, 1, 2, . . . , n−1

When a sampling frequency of an input signal is chosen to be 8000 [Hz], or a frequency band of an input signal is chosen to be 4000 [Hz], P[0], P[1], P[2], . . . , P[n−2], P[n−1] express powers of frequency components which result from dividing the band width of 4000 [Hz] by equally n. At that time, if n=32, then frequencies equivalent to P[0], P[1], P[2], . . . , P[30], P[31] are expressed on the following table 3.

TABLE 3

| Output value of sub-band power calculate-ion unit 51 | | Corresponding frequency | Output value of sub-band power calculate-ion unit 51 | | Corresponding frequency |
|---|---|---|---|---|---|
| P [0] | (S9-0) | 0 Hz | P [16] | (S9-16) | 2000 Hz |
| P [1] | (S9-1) | 125 Hz | P [17] | (S9-17) | 2125 Hz |
| P [2] | (S9-2) | 250 Hz | P [18] | (S9-18) | 2250 Hz |
| P [3] | (S9-3) | 375 Hz | P [19] | (S9-19) | 2375 Hz |
| P [4] | (S9-4) | 500 Hz | P [20] | (S9-20) | 2500 Hz |
| P [5] | (59-5) | 625 Hz | P [21] | (S9-21) | 2625 Hz |
| P [6] | (S9-6) | 750 Hz | P [22] | (S9-22) | 2750 Hz |
| P [7] | (S9-7) | 875 Hz | P [23] | (S9-23) | 2875 Hz |
| P [8] | (S9-8) | 1000 Hz | P [24] | (S9-24) | 3000 Hz |
| P [9] | (S9-9) | 1125 Hz | P [25] | (S9-25) | 3125 Hz |
| P [10] | (S9-10) | 1250 Hz | P [26] | (S9-26) | 3250 Hz |
| P [11] | (S9-11) | 1375 Hz | P [27] | (S9-27) | 3375 Hz |

TABLE 3-continued

| Output value of sub-band power calculate-ion unit 51 | | Corresponding frequency | Output value of sub-band power calculate-ion unit 51 | | Corresponding frequency |
|---|---|---|---|---|---|
| P [12] | (S9-12) | 1500 Hz | P [28] | (S9-28) | 3500 Hz |
| P [13] | (S9-13) | 1625 Hz | P [29] | (S9-29) | 3625 Hz |
| P [14] | (S9-14) | 1750 Hz | P [30] | (S9-30) | 3750 Hz |
| P [15] | (S9-15) | 1875 Hz | P [31] | (S9-31) | 3875 Hz |

Therefore, it is possible to obtain the power values of the respective frequency components with a resolution of 125 [Hz].

The case that the frequency band width of the input signal is chosen to be 8000 [Hz] will be considered herein. If the frequency is analyzed with a resolution finer than 125 [Hz], e.g., the frequency is analyzed with a resolution of 62.5 [Hz] or 31.25 [Hz], then n=64 or n=128. Further, if the frequency is analyzed with a resolution more coarse than 125 [Hz], e.g., the frequency is analyzed with a resolution of 250 [Hz] or 500 [Hz], then n=16 or n=8. If other sampling frequencies are used, then the value of n will be determined similarly as described above.

Figure 3A:
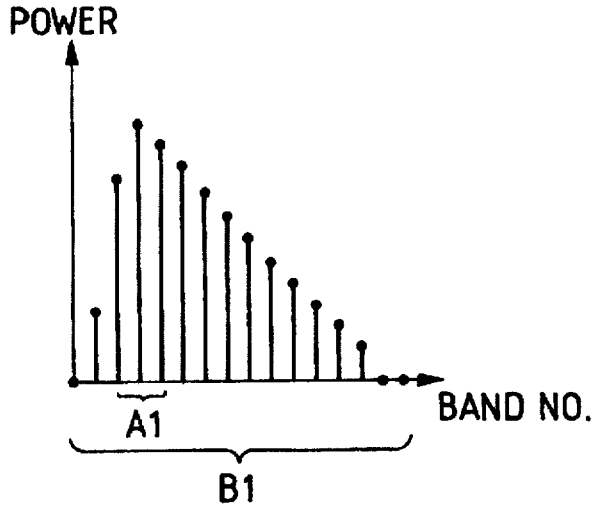
FIGS. 3A to 3C are schematic diagrams used to explain an operation of the tone detection unit in the signal discrimination circuit shown in FIG. 1.
Figure 3B:
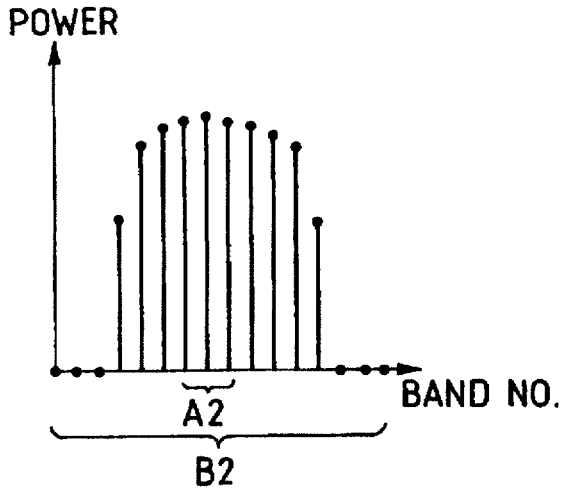
Figure 3C:
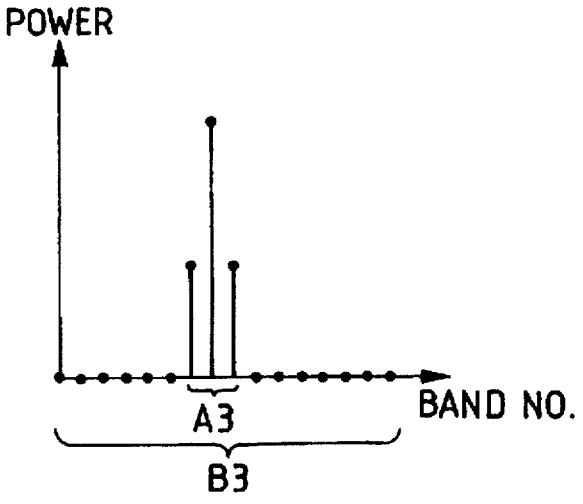

Then, the tone detection unit 52 judges the presence or absence of the tone signal on the basis of the outputs S9-0 to S9-(n−1) of the sub-band power calculation unit 51. If the tone detection unit 52 detects the tone signal, then the value "1" is set to the output S10. If on the other hand the tone signal is not detected, then the value "0" is set to the output S10. FIGS. 3A to 3C show how the tone detection unit 52 operates when various signals are input to this signal discrimination circuit.

FIG. 3A shows an output of the sub-band power calculation unit 51 when the voice signal is input to the signal discrimination circuit. FIG. 3B shows an output of the sub-band power calculation unit 51 when the voiceband data signal is input to the signal discrimination circuit. FIG. 3C shows an output of the sub-band power calculation unit 51 when the tone signal is input to the signal discrimination circuit. As clear from FIGS. 3A to 3C, a power of the output of the sub-band power calculation unit 51 is dispersed in a wide frequency band when the voice signal or the voiceband data signal is input to the signal discrimination circuit. A power thereof is concentrated in a narrow frequency band around the frequency of the tone signal when the tone signal is input. The tone detection unit 52 according to this embodiment determines on the basis of such features whether or not the input signal is the tone signal.

The processing done by the tone detection unit 52 will be described in detail. Sub-band power values S9-0 to S9-(n−1) input to the tone detection unit 52 are supplied through the signal lines S12-0 to S12-(n−1) and S13-0 to S13-(n−1) to the peak frequency power addition unit 40 and the whole band power addition unit 42, respectively. Initially, the peak frequency power addition unit 40 calculates a band in which a power of the sub-band powers S9-0 to S9-(n−1) becomes maximum and adds the power value of this band and power values of N frequency bands adjacent to the foregoing band. Then, the peak frequency power addition unit 40 outputs an added value S14. When P[kmax] ($0 \leq kmax \leq n-1$) of the power values P[k] (k=0, 1, 2, . . . , n−1) becomes maximum, if the power value P[kmax] of the band in which the power becomes maximum and the power values (P[kmax−1], P[kmax+1]) of the bands adjacent to the foregoing frequency band are added, then N=2. The value of N is properly determined based on the window function used in the FFT calculation unit 50 and a required performance of the tone detection unit 52.

The whole band power addition unit 42 calculates all power values S9-0 to S9-(n−1) output from the sub-band power calculation unit 51 and outputs an added value S15. The judgement unit 43 performs on the basis of the output S14 of the peak frequency power addition unit 40 and the output S15 of the whole band power addition unit 42 a judgement within the analysis frame to determine whether or not the input signal is the tone signal. Then, the judgement unit 43 performs a final judgement of tone signal detection by using tone signal detected results obtained within a plurality of consecutive analysis frames and then outputs judged result as an output S10.

When the input signal is the tone signal with the single frequency, as shown in FIG. 3C, a frequency spectrum of a signal is concentrated on one frequency band so that most power values of the single-frequency tone signal are included in a frequency band (shown by A3 in FIG. 3C) added by the peak frequency power addition unit 40. Accordingly, the output S14 of the peak frequency power addition unit 40 and the output S15 obtained from the whole band power addition unit 42 when powers of the whole frequency band (shown by B3 in FIG. 3C) are added by the whole band power addition unit 42 become substantially equal to each other.

When on the other hand the input signal is the voice signal or the voiceband data signal, as shown in FIGS. 3A and 3B, the frequency spectrum distribution of the signal is widened as compared with the frequency spectrum distribution obtained when the tone signal is input. Therefore, the output S14 obtained from the peak frequency power addition unit 40 when the power values of the bands shown by A1, A2 in FIGS. 3A and 3B are added by the peak frequency power addition unit 40 becomes smaller than the output S15 obtained from the whole band power addition unit 42 when the power values of the frequency bands shown by B1, B2 in FIGS. 3A and 3B. Therefore, if the output S14 of the peak frequency power addition unit 40 and the output S15 of the whole band power addition unit 42 establish therebetween a relationship expressed by the following equation (5), it is judged that the tone signal is detected within the analysis frame.

$$\frac{\text{output of peak frequency power addition unit 40}}{\text{output of whole band power addition unit 42}} > Th1 \quad (5)$$

If on the other hand the relationship expressed by the equation (5) is not established, then it is judged that the tone signal cannot be detected within the analysis frame. In the equation (5), reference symbol Th1 depicts a previously-determined threshold value.

If the present or absence of tone signal is judged only within one analysis frame, there is then the possibility that the present of tone signal will be erroneously detected when the input signal is the voice signal or the voiceband data signal. Therefore, it is finally determined on the basis of the tone signal detected results obtained within a plurality of consecutive analysis frames whether or not the tone signal is detected. If the tone signal is detected in N2 or more analysis frames out of N1 consecutive analysis frames, then the output S10 of the judgement unit 43 is set to a value "1" (tone signal could be detected). If not, then the output S10 of the judgement unit 43 is set to a value "0" (tone signal could not be detected).

The discriminated result output unit 53 determines on the basis of the output S10 of the tone detection unit 52, the output S5 of the electric power judgement unit 2 and the output S6 of the zero-crossing number judgement unit 3 whether the input signal is the voice signal or the voiceband data signal. A truth table which shows the states of signals input to and output from the discriminated result output unit 53 is illustrated on the following table 4.

TABLE 4

| | | | | | |
|---|---|---|---|---|---|
| Output (S10) of tone detection unit 52 | 0 | 0 | 0 | 0 | 1 |
| Output (S5) of electric power judgement unit 2 | 0 | 0 | 1 | 1 | X |
| Output (S6) of zero-crossing number judgement unit 3 | 0 | 1 | 0 | 1 | X |
| Logical product of outputs S5 and S6 | 0 | 0 | 0 | 1 | X |
| Output (S11) of discriminated result output unit 53 | 0 | 0 | 0 | 1 | 0 |

S10

0: Tone signal could not be detected.

1: Tone signal could be detected.

S5 to S11

0: Input signal is judged as voice signal.

1: Input signal is judged as voiceband data signal.

X: Input signal may be judged as voice signal or voiceband data signal.

Having studied the table 4, when the output S10 of the tone detection unit 52 is the value "0" (tone signal could not be detected), a logical product of the output S5 of the electric power judgement unit 2 and the output S6 of the zero-crossing number judgement unit 3 is set to the output S11 of the discriminated result output unit 53.

Specifically, if the output S5 of the electric power judgement unit 2 and the output S6 of the zero-crossing number judgement unit 3 are both held at the value "1" then it is determined that the input signal is the voiceband data signal and the value "1" is set in the output S11, and if at least one of the outputs of the electric power judgement unit 2 and the zero-crossing number judgement unit 3 is held at the value "0", then it is determined that the input signal is the voice signal and value "0" is set in the output S11. If on the other hand the output S10 of the tone detection unit 52 is held at the value "1" (tone signal could be detected), regardless of the output S5 of the electric power judgement unit 2 and the output S6 of the zero-crossing number judgement unit 3, the value "0" (voice signal) is set to the output S11 of the discriminated result output unit 53.

According to the above-mentioned arrangement, when the input signal, such as the single frequency tone signal whose frequency spectrum is concentrated on the local portion is supplied, it is possible to detect the tone signal with the single frequency by using the feature that the ratio of the output S14 of the peak frequency power addition unit 40 relative to the output S15 of the whole band power addition unit 42 is increased. Further, if the operation of the discriminated result output unit 53 is controlled by the output S10 of the tone detection unit 52, then the output S11 obtained from the signal discrimination circuit when the tone signal is input can be set to the value "0" (voice signal).

Embodiment 2

Figure 4:
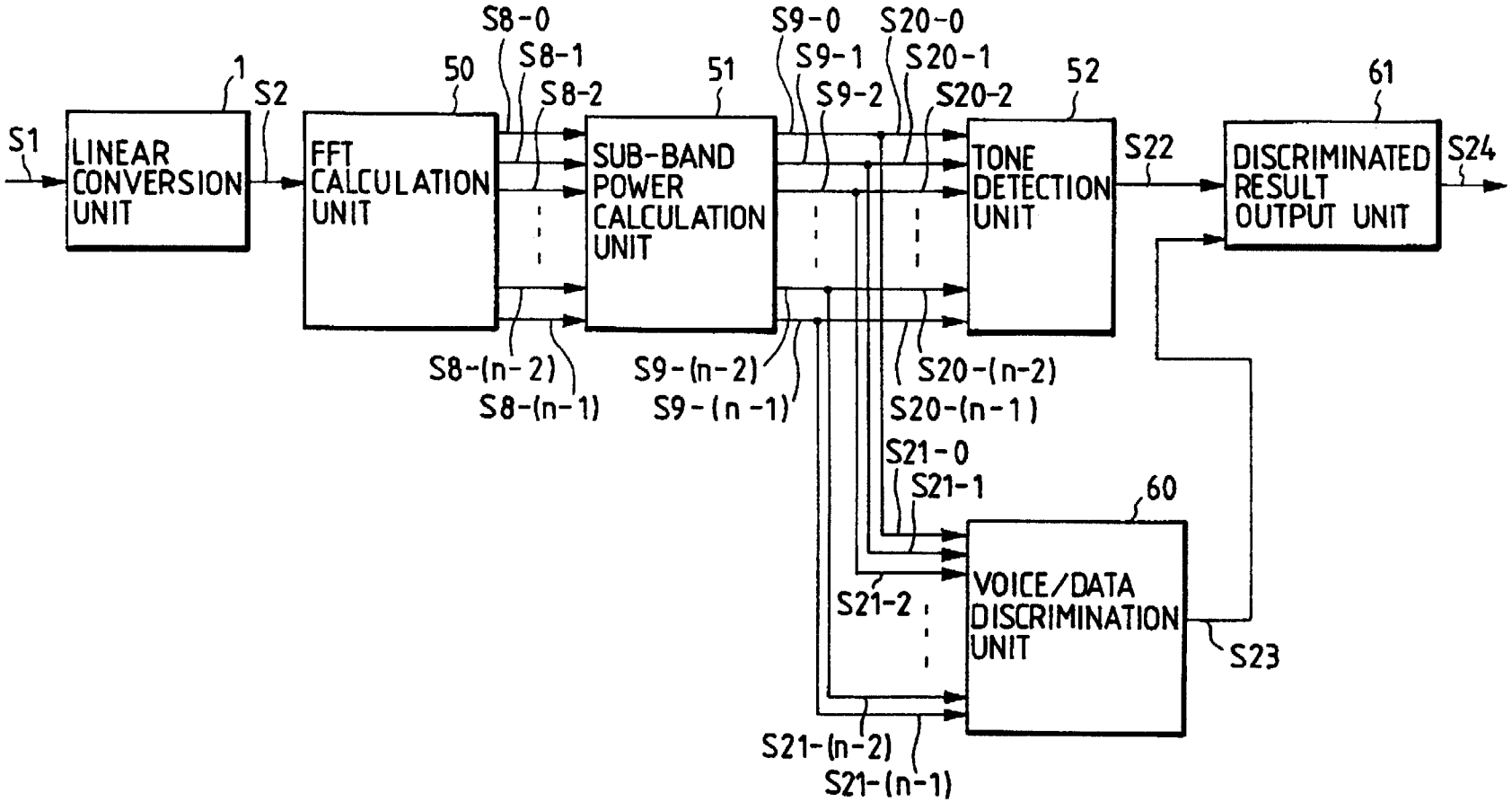
FIG. 4 is a block diagram showing an arrangement of a signal discrimination circuit according to an embodiment 2.

FIG. 4 shows an arrangement of a signal discrimination circuit according to the embodiment 2. In FIG. 4, like elements and parts corresponding to those of FIG. 1 are marked with the same references. As shown in FIG. 4, there is provided a voice/data discrimination unit 60 which receives the outputs S9-0 to S9-(n−1) of the sub-band power calculation unit 51 through signal lines S21-0 to S21-(n−1). The voice/data discrimination unit 60 determines on the basis of the powers of the respective bands whether the input signal is the voice signal or the voiceband data signal. A discriminated result output unit 61 determines on the basis of outputs S22, S23 of the tone detection unit 52 and the voice/data discrimination unit 60 whether the input signal S1 is the voice signal or the voiceband data signal.

Figure 5:
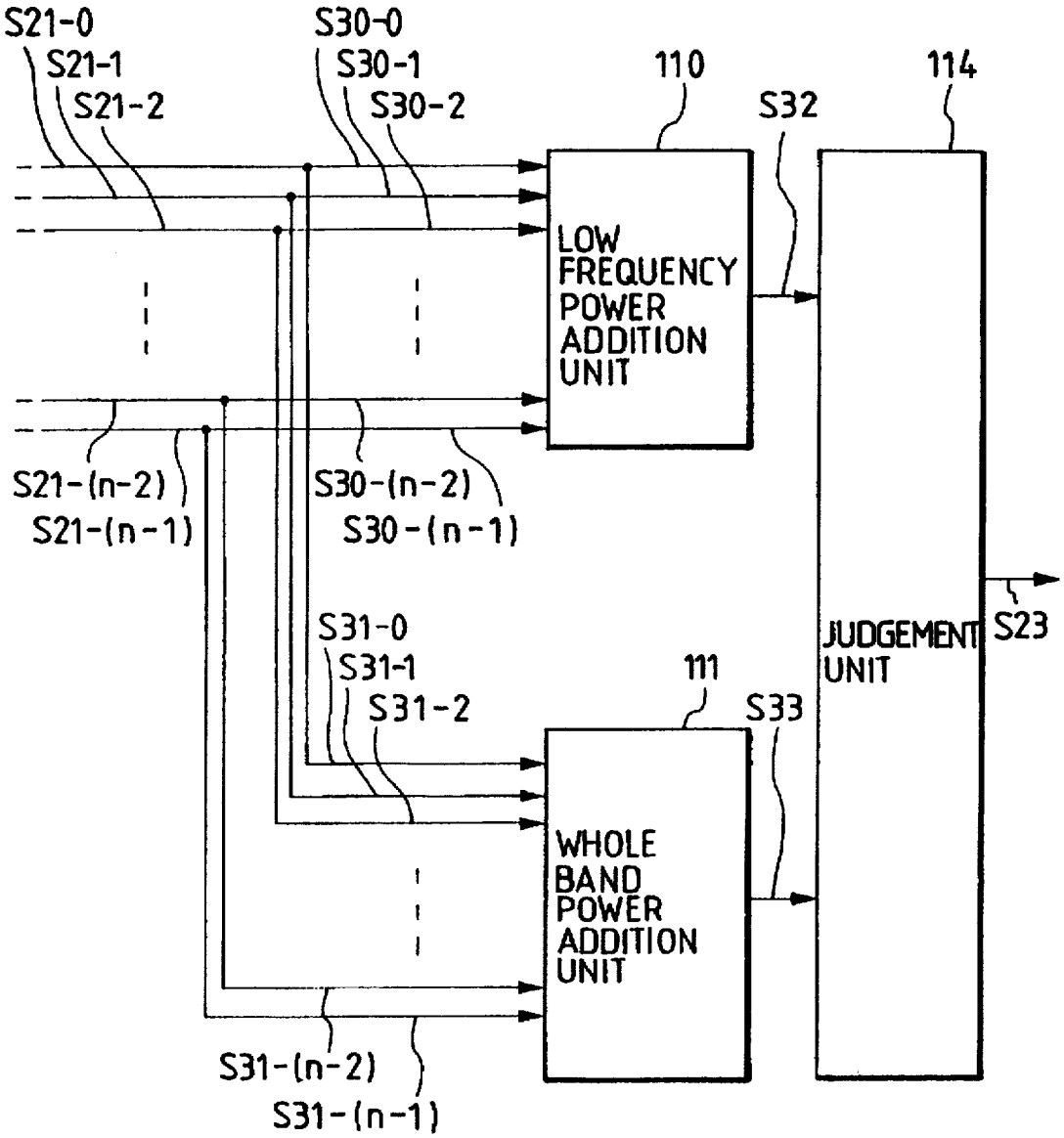
FIG. 5 is a block diagram showing an arrangement of a voice/data discrimination unit in the signal discrimination circuit shown in FIG. 4.

FIG. 5 shows an arrangement of the voice/data discrimination unit 60 in detail. As shown in FIG. 5, there is provided a low frequency power addition unit 110 which adds only power values of the low frequency bands of the outputs S9-0 to S9-(n−1) input thereto from the sub-band power calculation unit 51 through the signal lines S21-0 to S21-(n−1). There is provided a whole band power addition unit 111 which adds whole band power values of the outputs S9-0 to S9-(n−1) input thereto from the sub-band power calculation unit 51 through the signal lines S21-0 to S21-(n−1) and S31-0 to S31-(n−1). Further, there is provided a judgement unit 114 which determines on the basis of outputs S32 and S33 of the low frequency power addition unit 110 and the whole band power addition unit 111 whether the input signal is the voice signal or the voiceband data signal.

With the above-mentioned arrangement, the outputs S9-0 to S9-(n−1) of the sub-band power calculation unit 51 are input through the signal lines S20-0 to S20-(n−1) and S21-0 to S21-(n−1) to the tone detection unit 52 and the voice/data discrimination unit 60. The voice/data discrimination unit 60 determines on the basis of the outputs S9-0 to S9-(n−1) of the sub-band power calculation unit 51 whether the input signal S1 is the voice signal or the voiceband data signal. Then, the voice/data discrimination unit 60 transmits a judged result as an output S23.

Figure 6A:
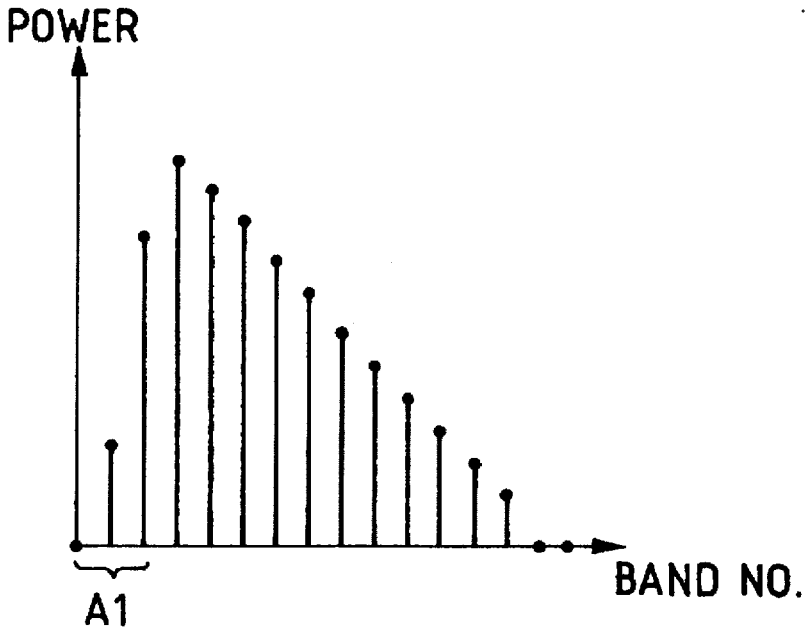
FIGS. 6A and 6B are schematic diagrams used to explain an operation of the voice/data discrimination unit in the signal discrimination circuit shown in FIG. 4.
Figure 6B:
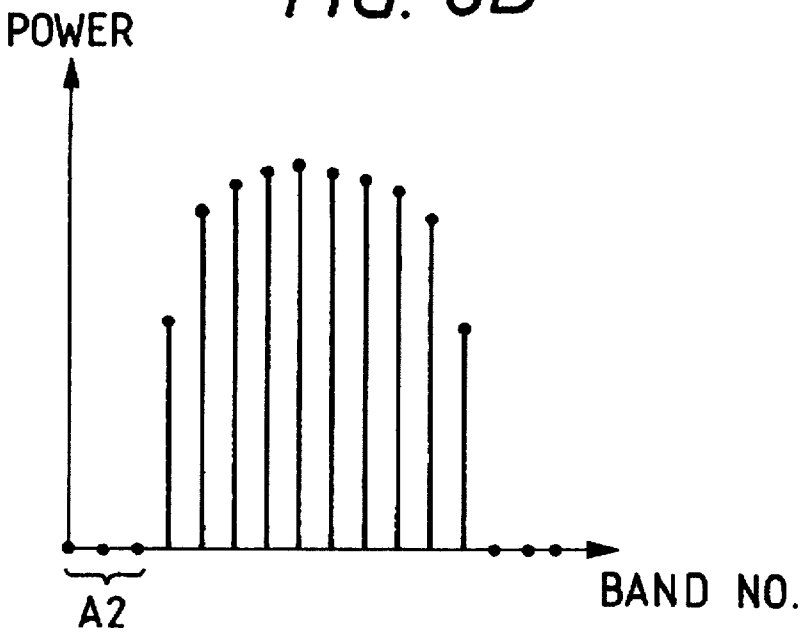

FIGS. 6A and 6B show an operation of the voice/data discrimination unit 60. FIG. 6A shows an output obtained from the sub-band power calculation unit 51 when the voice signal is input. FIG. 6B shows an output obtained from the sub-band power calculation unit 51 when the voiceband data signal is input. As shown in FIG. 6A, when the input signal is the voice signal, a power distribution is concentrated in the low frequency bands. As shown in FIG. 6B, when the input signal is the voiceband data signal, a frequency spectrum thereof becomes a relatively flat distribution around a carrier frequency of MODEM and a distribution range is limited. It is possible to determine on the basis of the aforesaid feature whether the input signal is the voice signal or the voiceband data signal.

The input signals S9-0 to S9-(n−1) to the voice/data discrimination unit 60 are input through the signal lines S21-0 to S21-(n−1) and S30-0 to S30-(n−1), S21-0 to S21-(n−1) and S31-0 to S31-(n−1) to the low frequency power addition unit 110 and the whole power addition unit 111, respectively. The low frequency power addition unit 110 adds powers of bands corresponding to the low frequency regions of the sub-band powers S9-0 to S9-(n−1) and transmits an added value as an output S32. If reference symbols A1 and A2 depict regions added as the low frequency bands in FIGS. 6A and 6B, then when the input signal is the voice signal, the magnitude of the output S32 of the low frequency power addition unit 110 becomes large as compared with the case that the input signal is the voiceband data signal.

The whole band power addition unit 111 adds all power values S9-0 to S9-(n−1) output from the sub-band power calculation unit 51 and supplies an added value to the judgement unit 114 as an output S33. The judgement unit 114 determines on the basis of the outputs S32, S33 of the low frequency power addition unit 110 and the whole band power addition unit 111 within the analysis frame whether the input signal is the voice sinal or the voiceband data signal. Then, it is finally determined on the basis of judged results obtained within a plurality of consecutive analysis frames whether the input signal is the voice signal or the voiceband data signal. The judgement unit 114 transmits a judged result as the output S23.

In actual practice, the judgement unit 114 initially calculates a ratio between the output S32 of the low frequency power addition unit 110 and the output S33 of the whole band power addition unit 111. Then, the judgement unit 114 determines on the basis of the following equation within the analysis frame whether the input signal is the voice signal or the voiceband data signal.

$$\frac{\text{output of low frequency power addition unit 110}}{\text{output of whole band power addition unit 111}} > Th2 \qquad (6)$$

In the equation (6), reference symbol Th2 denotes a previously-determined threshold value. If the input signal is the voice signal, then a value on the left-hand side member of the equation (6) becomes large as compared with the case that the input sinal is the voiceband data signal. Therefore, if the equation (6) is satisfied, then it is determined within this analysis frame that the input signal is the voice signal. If on the other hand the equation (6) is not satisfied, then it is determined within this analysis frame that the input signal is the voiceband data signal.

Then, it is finally determined on the basis of judged results obtained within a plurality of consecutive analysis frames whether the input signal is the voice signal or the voiceband data signal. If it is determined in N4 or more analysis frames out of N3 consecutive analysis frames that the input signal is the voice signal, then the output S23 of the judgement unit 114 is set to the value "0" (voice signal). If it is determined in N6 or more analysis frames out of N5 consecutive analysis frames that the input signal is the voiceband data signal, then the output S23 of the judgement unit 114 is set to the value "1" (voiceband data signal). If it is determined that the input signal is neither the voice signal nor the voiceband data signal, then the output S23 of the judgement unit 114 holds the previous state.

The discriminated result output unit 61 determines on the basis of the output S22 of the tone detection unit 52 and the output S23 of the voice/data discrimination unit 60 whether the input signal is the voice signal or the voiceband data signal. Then, the discriminated result output unit 61 transmits a judged result as an output S24. The following table 5 shows a truth table which indicates states of signals input to and output from the discriminated result output unit 61.

TABLE 5

| | | | | |
|---|---|---|---|---|
| Output (S22) of tone detection unit 52 | 0 | 0 | 1 | 1 |
| Output (S23) of voice/data discrimination unit 60 | 0 | 1 | 0 | 1 |
| Output (S24) of discriminated result output unit 61 | 0 | 1 | 0 | 0 |

If the output S22 of the tone detection unit 52 is held at the value "0" (tone signal is not detected) as shown on the above table 5, then the judged result S23 of the voice/data discrimination unit 60 is set to the output S24 of the discriminated result output unit 61. If on the other hand the output S22 of the tone detection unit 52 is held at the value "1" (tone signal is detected), then regardless of the judged result of the voice/data discrimination unit 60, the output S24 of the discriminated result output unit 61 is set to the value "0" (voice signal).

With the above-mentioned arrangement, when the input signal, such as the voice signal whose power distribution is concentrated on the low frequency band is supplied, it is possible to reliably discriminate the input voice signal from the voiceband data signal by using the feature that the ratio of the output S32 of the low frequency power addition unit 110 relative to the output S33 of the whole band power addition unit 111 is increased. Moreover, if the sub-band power values that had been used by the tone detection unit 52 to detect the tone signal is used by the voice/data discrimination unit 60, then the voice/data discrimination unit 60 need not calculate the zero-crossing number and the interblock electric power ratio unlike the embodiment 1. Therefore, the arrangement of the signal discrimination circuit can be simplified much more.

Embodiment 3

While the discriminated result output unit 53 causes the output S11 to be set to the value "0" (voice signal) when the output S10 of the tone detection unit 52 is held at the value "1" (tone signal is detected) in the aforesaid embodiment 1, the present invention is not limited thereto and the output S11 of the discriminated result output unit 53 may be held in the previous state if the output S10 of the tone detection unit 52 is set to the value "1" (tone signal is detected). Therefore, when the tone signal input to the signal discrimination circuit is a part of the signal transmitted during the MODEM communication, such as an unmodulated carrier signal generated by MODEM, it is possible to effectively prevent the signal discriminated result from becoming the voice signal.

Embodiment 4

While the discriminated result output unit 61 causes the output S24 to be set to the value "0" (voice.signal) when the output S22 of the tone detection unit 52 is held at the value "1" (tone signal is detected) in the aforesaid embodiment 2, the present invention is not limited thereto and the output S24 of the discriminated result output unit 61 may be held in the previous state if the output S22 of the tone detection unit 52 is set to the value "1" (tone signal is detected). If so, it is then possible to achieve similar effects to those of the above-mentioned embodiment 3.

Embodiment 5

Figure 7:
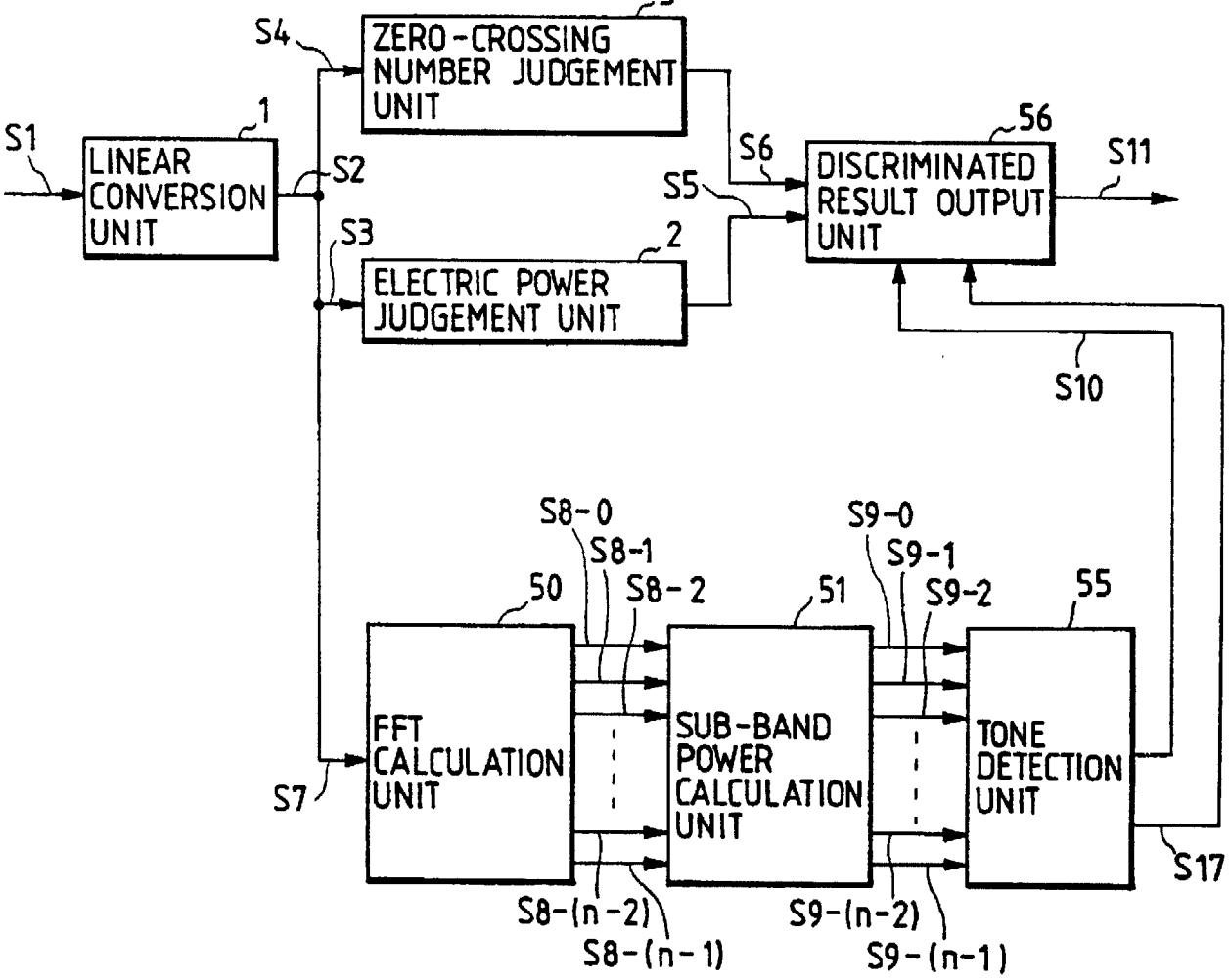
FIG. 7 is a block diagram showing an arrangement of a signal discrimination circuit according to an embodiment 5.
Figure 8:
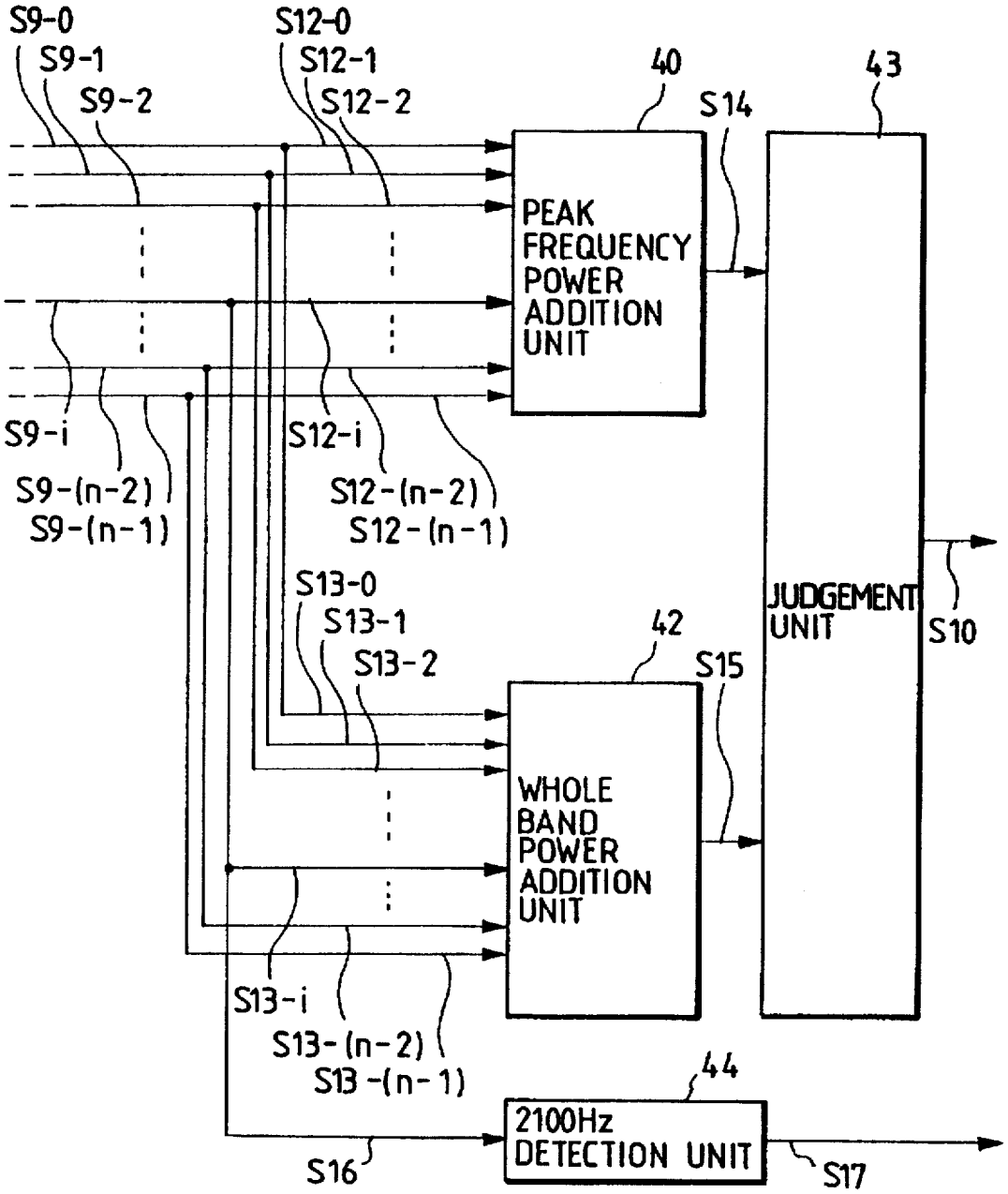
FIG. 8 is a block diagram showing an arrangement of a tone detection unit in the signal discrimination circuit shown in FIG. 7.

FIG. 7 shows an arrangement of an embodiment 5 of the signal discrimination circuit. In FIG. 7, like parts corresponding to those of FIG. 1 are marked with the same references. As shown in FIG. 7, there is provided a tone detection unit 55 which receives the outputs S9-0 to S9-(n−1) from the sub-band power calculation unit 51 to determine the presence or absence of the tone signal and the presence or absence of the 2100 [Hz] tone signal on the basis of sub-band powers. There is provided a discriminated result output unit 56 which determines on the basis of the outputs S5, S6, S10 and S17 of the electric power judgement unit 2, the zero-crossing number judgement unit 3 and the tone detection unit 55 whether the input signal is the voice signal or the voiceband data signal. FIG. 8 shows an arrangement of the tone detection unit 55 in detail. In FIG. 8, like parts corresponding to those of FIG. 2 are marked with the same references. As shown in FIG. 8, there is provided a 2100 [Hz] detection unit 44 which detects the presence or absence of the 2100 [Hz] tone signal.

With the above-mentioned arrangement, in the tone detection unit according to this embodiment, among the outputs S9-0 to S9-(n−1) of the sub-band power calculation unit 51, a power value S9-i of the band closest to 2100 [Hz] is input through the signal line S16 to the 2100 [Hz] detection unit 44. When the sampling frequency of the input signal is 8000 [Hz] and n=32, the outputs S9-0 to S9-(n−1) of the sub-band power calculation unit 51 are obtained as shown on the table 3. Therefore, the power value of the band closest to the 2100 [Hz] band becomes P[17] (S9-17). Accordingly, in this case, the power value P[17] (S9-17) is input through the signal line S16 to the 2100 [Hz] detection unit 44.

The 2100 [Hz] detection unit 44 receives the power value S9-i of the band closest to 2100 [Hz] and compares this input value and the previously-determined threshold value. If the input value is larger than the threshold value, the 2100 [Hz] detection unit 44 judges within the frame that the 2100 [Hz] tone signal can be detected. If not, then the 2100 [Hz] detection unit 44 judges within the frame that the 2100 [Hz] tone signal cannot be detected. On the same ground as that of the embodiment 1, it is finally determined on the basis of 2100 [Hz] tone signal detected results obtained within a plurality of consecutive analysis frames whether or not the 2100 [Hz] tone signal is detected. If the 2100 [Hz] tone signal is detected in N8 or more analysis frames out of consecutive N7 analysis frames, then the output S17 of the 2100 [Hz] detection unit 44 is set to the value "1" (2100 [Hz] tone signal is detected). If not, then the output S17 of the 2100 [Hz] detection unit 44 is set to the value "0" (2100 [Hz] tone signal is not detected).

The tone detection unit 55 outputs the tone signal detected result S10 output from the judgement unit 43 and the 2100 [Hz] detected result S17 output from the 2100 [Hz] detection unit 44 to the discriminated result output unit 56. The discriminated result output unit 56 determines on the basis of the outputs S10, S17 of the tone detection unit 55, the output S5 of the electric power judgement unit 2 and the output S6 of the zero-crossing number judgement unit 3 whether the input signal is the voice signal or the voiceband data signal. The following table 6 shows a truth table which indicates states of signals input to and output from the discriminated result output unit 56.

TABLE 6

| | | | | | | |
|---|---|---|---|---|---|---|
| Output of tone detection unit 55 2100 [HZ] detected result (S17) | 0 | 0 | 0 | 0 | 0 | 1 |
| Output of tone detection unit 55 Tone detected result (S10) | 0 | 0 | 0 | 0 | 1 | X |
| Output (S5) of electric power judgement unit 2 | 0 | 0 | 1 | 1 | X | X |
| Output (S6) of zero-crossing number judgement unit 3 | 0 | 1 | 0 | 1 | X | X |
| Logical product of outputs S5 and S6 | 0 | 0 | 0 | 1 | X | X |
| Output (S11) of discriminated result output unit 56 | 0 | 0 | 0 | 1 | 0 | 1 |

S17
0: 2100 [Hz] tone signal is not detected.
1: 2100 [Hz] tone signal is detected.
X: 2100 [Hz] tone signal may not be detected or may be detected.
S10
0: tone signal is not detected.
1: tone signal is detected.
X: tone signal may not be detected or may be detected
S5 to S11
0: input signal is judged as voice signal.
1: input signal is judged as the voiceband data signal.
X: input signal may be judged as voice signal or voiceband data signal.

When the 2100 [Hz] detected result S17 output from the tone detection unit 55 is held at the value "1" (2100 [Hz] tone signal is detected), regardless of the tone detected result S10 output from the tone detection unit 55, the output S5 of the electric power judgement unit 2 and the output S6 of the zero-crossing number judgement unit 3, it is determined on the basis of the above table 6 that the input signal is the voiceband data signal. Then, the value "1" is set to the output S11.

Then, when the 2100 [Hz] detected result S17 output from the tone detection unit 55 is held at the value "0" (2100 [Hz] tone signal is not detected) and the tone detected result S10 output from the tone detection unit 55 is held at the value "1" (tone signal is detected), regardless of the output S5 of the electric power judgement unit 2 and the output S6 of the zero-crossing number judgement unit 3, it is determined on the basis of the above table 6 that the input signal is the voice signal. Then, the value "0" is set to the output S11. Subsequently, when the 2100 [Hz] detected result S17 output from the tone detection unit 55 is held at the value "0" (2100 [Hz] tone signal is not detected) and the tone detected result S10 output from the tone detection unit 55 is held at the value "0" (tone signal is not detected), a logical product of the output S5 of the electric power judgement unit 2 and the output S6 of the zero-crossing number judgement unit 3 are used as the output of the discriminated result output unit 56. Specifically, when the output S5 of the electric power judgement unit 2 and the output S6 of the zero-crossing number judgement unit 3 are both held at the value "1", it is determined that the input signal is the voiceband data signal. Then, the value "1" is output to the S11. Further, when at least one of the output S5 of the electric power judgement unit 2 and the output S6 of the zero-crossing number judgement unit 3 is held at the value "0", it is determined that the input signal is the voice signal. Then, the value "0" is output to the output S11.

According to the above-mentioned arrangement, the 2100 [Hz] tone signal that is used in the MODEM communication procedure can be reliably detected on the basis of the power value of the band close to 2100 [Hz] of the sub-band powers and the 2100 [Hz] tone signal can be classified into voiceband data signal.

Embodiment 6

Also in the above-mentioned embodiment 2, if the tone detection unit 52 is added with a 2100 [Hz] tone signal detection function, then when the tone detection unit 52 detects the 2100 [Hz] tone signal, the output S24 of the discriminated result output unit 61 is forced to be set to the value "1" (voiceband data signal) and when a tone signal other than the 2100 [Hz] tone signal is detected, the output S24 of the discriminated result output unit 61 is forced to be set to the value "0" (voice signal) or held in the previous state, it is possible to achieve similar effects to those of the embodiment 5.

Embodiment 7

Figure 9:
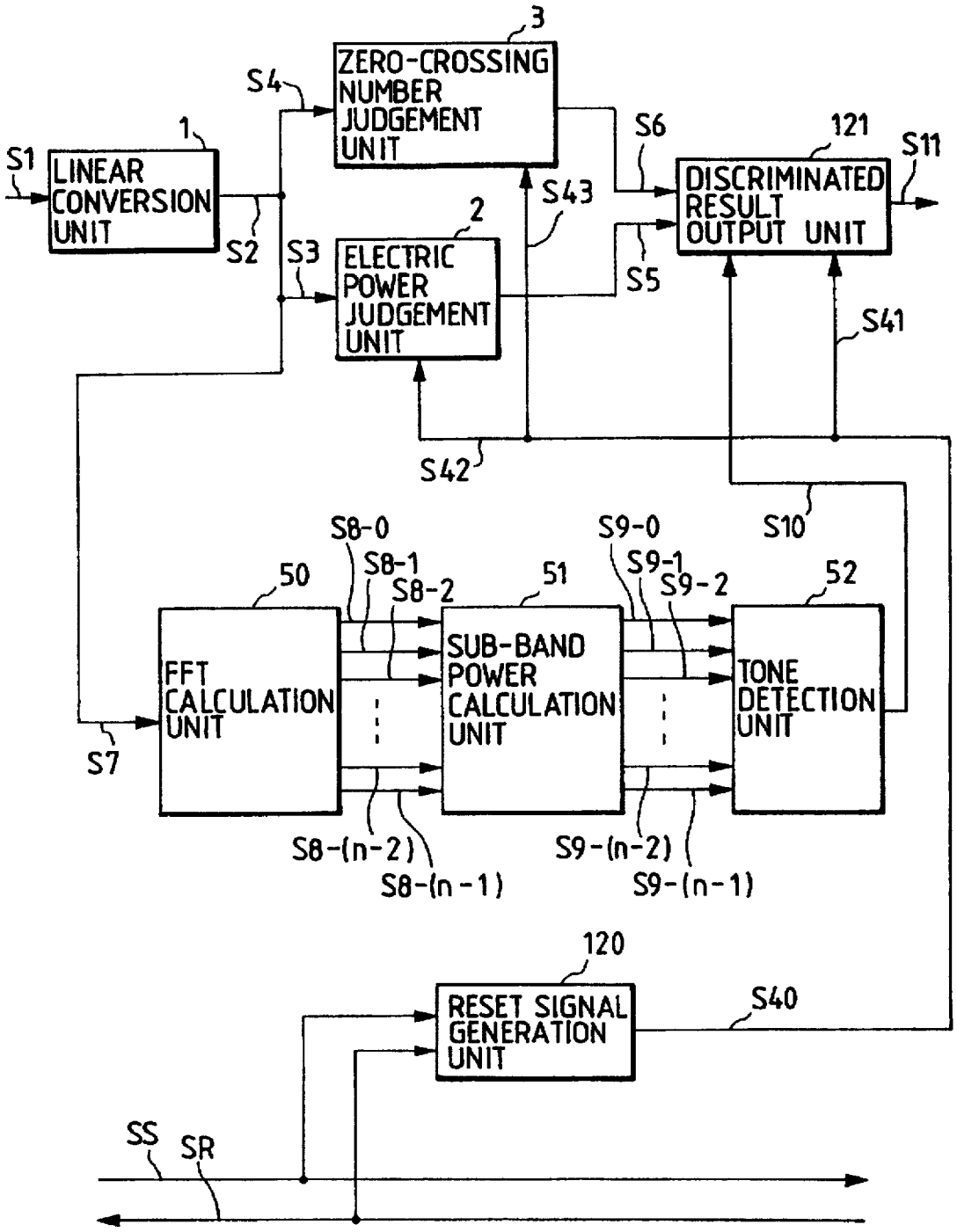
FIG. 9 is a block diagram showing an arrangement of a signal discrimination circuit according to an embodiment 7.

FIG. 9 shows an arrangement of the embodiment 7 of the signal discrimination circuit. In FIG. 9, like parts corresponding to those of FIG. 1 are marked with the same references. Reference symbols SS and SR in FIG. 9 designate signalling signals in the channel associated signalling system. Specifically, reference symbol SS designates a signalling signal from a local exchange and reference symbol SR designates a signalling signal from a remote exchange. There is provided a reset signal generation unit 120 which receives the signalling signal SS from the local exchange and the signalling signal SR from the remote exchange to generate a reset signal. A discriminated result output unit 121 determines on the basis of the outputs S5, S6, S10, S40 of the electric power judgement unit 2, the zero-crossing number judgement unit 3, the tone detection unit 52 and the reset signal generation unit 120 whether the input signal S1 is an voice signal or an voiceband data signal.

Figure 10:
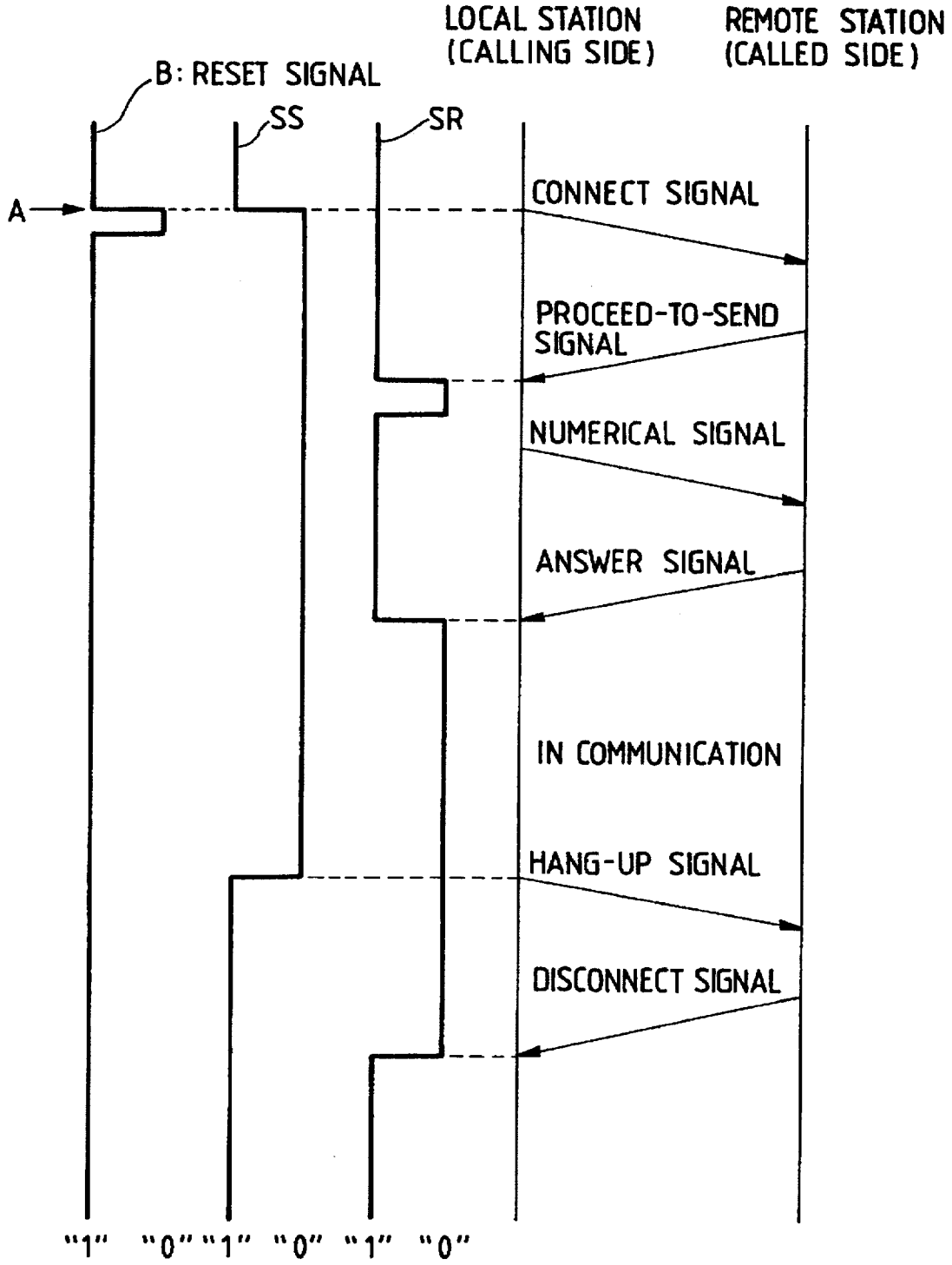
FIG. 10 is a timing chart used to explain an operation of the signal discrimination circuit shown in FIG. 9 when a local station side makes an outgoing call.

With the above-mentioned arrangement, the reset signal generation unit 120 receives the signalling signal SS from the local exchange and the signalling signal SR from the remote exchange and detects a call connection on the basis of the states of the signalling signals SS, SR. When detecting the call connection, the reset signal generating unit 120 outputs a reset signal S40. An operation executed when the local side user becomes the caller is illustrated in FIG. 10. FIG. 10 shows a sequence of transmitting and receiving control signals between the local exchange and the remote exchange when the local side user becomes the caller.

As shown in FIG. 10, in the state that the call connection has not be made, the signal states of the signalling signals SS, SR are both held at the value "1". In order to start the remote exchange, the local exchange initially changes the signalling signal SS from "1" to "0" (connect signal). When the remote exchange receives this connect signal, the remote exchange sets the signalling signal SR to the value "0" (proceed-to-send signal) during a certain time width in order to inform the local exchange that the remote exchange becomes ready for receiving the numerical signal. Then, when the local exchange receives the proceed-to-send signal, the local exchange transmits dial numeral information (numerical signal) to the remote exchange by a combination of tone signals of particular frequencies within the voiceband in order to inform the remote exchange whom this call should be connected to (party being called).

During this period, the signal state of the signalling signal SS is held at the value "0". Then, when the party being called answers the incoming call, the remote exchange changes the signalling signal SR from the value "1" to the value "0" (answer signal) in order to inform the local exchange that the party being called answers the incoming call. Therefore, the operation of the call connection is completed and a telephone communication becomes possible. When a telephone conversation is finished and the caller hangs up, the local exchange changes the signalling signal SS from the value "0" to the value "1" (hang-up signal) in order to inform the remote exchange that the calling party has hung up. When the remote exchange receives this hung-up signal, the remote exchange changes the signalling signal SR from the value "0" to the value "1" (disconnect signal) in order to inform the local exchange that the hung-up signal is detected. Thus, the call disconnect operation is ended.

When the local exchange side makes an outgoing call, under the condition that the call connect has not be made, the signal states of the signalling signals SS, SR are both held at the value "1". When the connect signal is transmitted from the local exchange side, the signalling signal SS is changed from the value "1" to the value "0". Therefore, when the signalling signal SR is held at the value "1" and it is detected that the signalling signal SS is changed from the value "1" to the value "0" (timing point shown at A in FIG. 10), it is possible to detect that the local exchange side has made an outgoing call.

Figure 11:
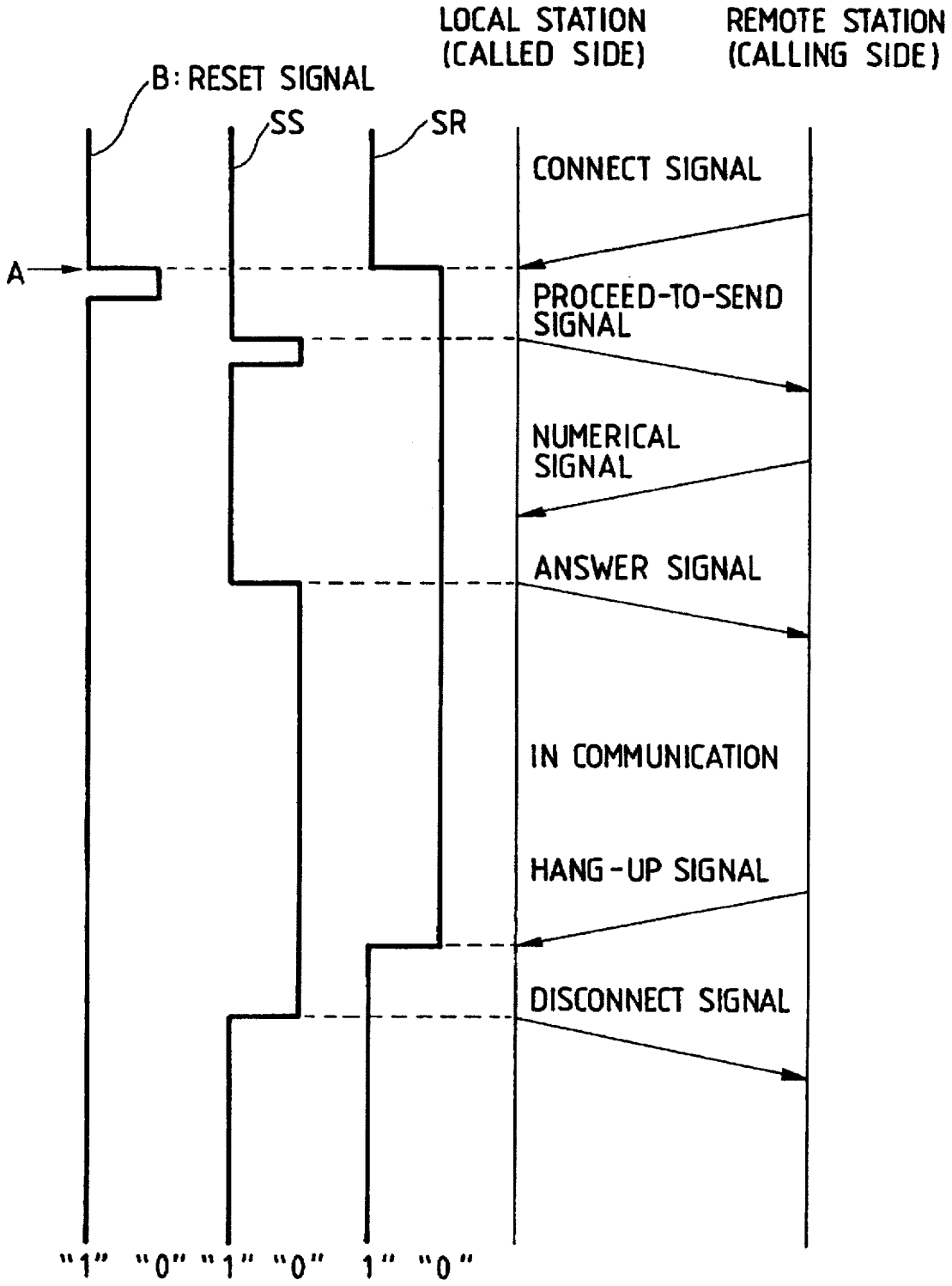
FIG. 11 is a timing chart used to explain an operation of the signal discrimination circuit shown in FIG. 9 when a local station side receives an incoming call.

An operation executed when the remote exchange side makes an outgoing call will be described below. FIG. 11 shows a signal sequence of the signalling signal SS transmitted from the local exchange and the signalling signal SR transmitted from the remote exchange under the condition that the remote exchange side makes an outgoing call. The signal sequence provided when the remote exchange makes an outgoing call as shown in FIG. 11 might be the same as the signal sequence provided when the local exchange side makes an outgoing call as shown in FIG. 10 in which the signalling signals SS and SR are replaced with each other.

When the remote exchange side makes an outgoing call, under the condition that the call connect has not be made, the signal states of the signalling signals SS, SR are both the value "1". Then, when the connect signal is transmitted from the remote exchange side, the signalling signal SR is changed from the value "1" to the value "0". Therefore, when the signalling signal SS is held at the value "1" and it is detected that the signalling signal SR is changed from the value "1" to the value "0" (timing point shown at A in FIG. 11), it is possible to detect that the remote exchange side has made an outgoing call.

Accordingly, the reset signal generating unit 120 determines that the local exchange side or the remote exchange side has made an outgoing call when it is detected that the signalling signal SR is held at the value "1" and that the signalling signal is changed from the value "1" to the value "0" or it is detected that the signalling signal SS is held at the value "1" and that the signalling signal SR is changed from the value "1" to the value "0". Then, the reset signal generation unit 120 sets the value "0" to the output S40 for a certain time width and uses this output S40 as the reset signal.

In other cases, the reset signal generation unit 120 sets "1" to the output S40. Specifically, the reset signal S40 obtained when the local exchange side makes the outgoing call becomes as shown at B in FIG. 10. The reset signal obtained when the remote exchange side makes the outgoing call becomes as shown at B in FIG. 11. The reset signal S40 is input through the signal lines S41, S42, S43 to the discriminated result output unit 121, the electric power judgement unit 2 and the zero-crossing number judgement unit 3, respectively.

The discriminated result output unit 121 makes the judged results based on the output S5 of the electric power judgement unit 2, the output S6 of the zero-crossing number judgement unit 3 and the output S10 of the tone detection unit 52 effective when the output S41 of the reset signal generating unit 120 is held at the value "1", or the reset signal generating unit 120 is deenergized. At that time, if the output S10 of the tone detection unit 52 is held at the value "0" (tone signal is not detected), then the discriminated result output unit 121 makes the discriminated results of the electric power judgement unit 2 and the zero-crossing number judgement unit 3 effective. Specifically, when the output S5 of the electric power judgement unit 2 and the output S6 of the zero-crossing number judgement unit 3 are both held at the value "1", it is determined that the input signal is the voiceband data signal. Then, the discriminated result output unit 121 sets the value "1" to the output S11. When at least one of the output S5 of the electric power judgement unit 2 and the output S6 of the zero-crossing number judgement unit 3 is held at "0", the discriminated result output unit 121 determines that the input signal is the voice signal. Then, the discriminated result output unit 121 sets "0" to the output S11.

When the output S41 of the reset signal generation unit 120 is held at the value "1", if the output S10 of the tone detection unit 52 is held at the value "1" (tone signal is detected), then regardless of the output S5 of the electric power judgement unit 2 and the output S6 of the zero-crossing number judgement unit 3, the output S11 of the discriminated result output unit 121 is held at the value "0" (voice signal) or held in the previous state.

On the other hand, when the output of the reset signal generating unit 120 is held at the value "0", or the reset signal generating unit 120 outputs the reset signal, regardless of the output S5 of the electric power judgement unit 2, the output S6 of the zero-crossing number judgement unit 3 and the output S10 of the tone detection unit 52, the output S11 of the discriminated result output unit 121 is set to the value "0" (voice signal). Further, when the outputs S42 and S43 of the reset signal generating unit 120 are held at the value "0", or the reset signal generating unit 120 outputs the reset signal, the electric power judgement unit 2 and the zero-crossing number judgement unit 3 reset their internal states such that their outputs S5 and S6 become the value "0" (voice signal).

With the above-mentioned arrangement, the reset signal generating unit 120 detects the call connection on the basis of the states of the signalling signals SS, SR. Then, when the call connection is detected, the reset signal generating unit 120 resets the discriminated state to the voice signal, to thereby place the initial state of the signal discriminated output obtained when a telephone communication is started to the voice signal.

Embodiment 8

In the above-mentioned embodiment 7, the states of the signalling signals SS, SR are monitored. Then, when the call connection is detected, the output S11 of the discriminated result output unit 121 is set to the value "0" (voice signal). The present invention is not limited thereto and there might be provided a means for detecting a call disconnection. Then, when the call disconnection is detected by such call disconnection detecting means, the output S11 of the signal discriminated output S11 may be set to the value "0" (voice signal) with similar effects to those of the embodiment 7 being achieved.

Embodiment 9

In the above-mentioned embodiments 7 and 8, the states of the signalling signals SS, SR are monitored by the channel associated signalling system and the present invention is not limited thereto. If the states of the signalling signals SS, SR are monitored by a common channel signalling system, then when the call connection signal or the call disconnection signal is detected by a call connection or call disconnection detecting means, the output S11 of the discriminated result output unit 121 may be set to the value "0" (voice signal) with similar effects to those of the embodiments 7 and 8 being achieved.

Embodiment 10

Figure 12:
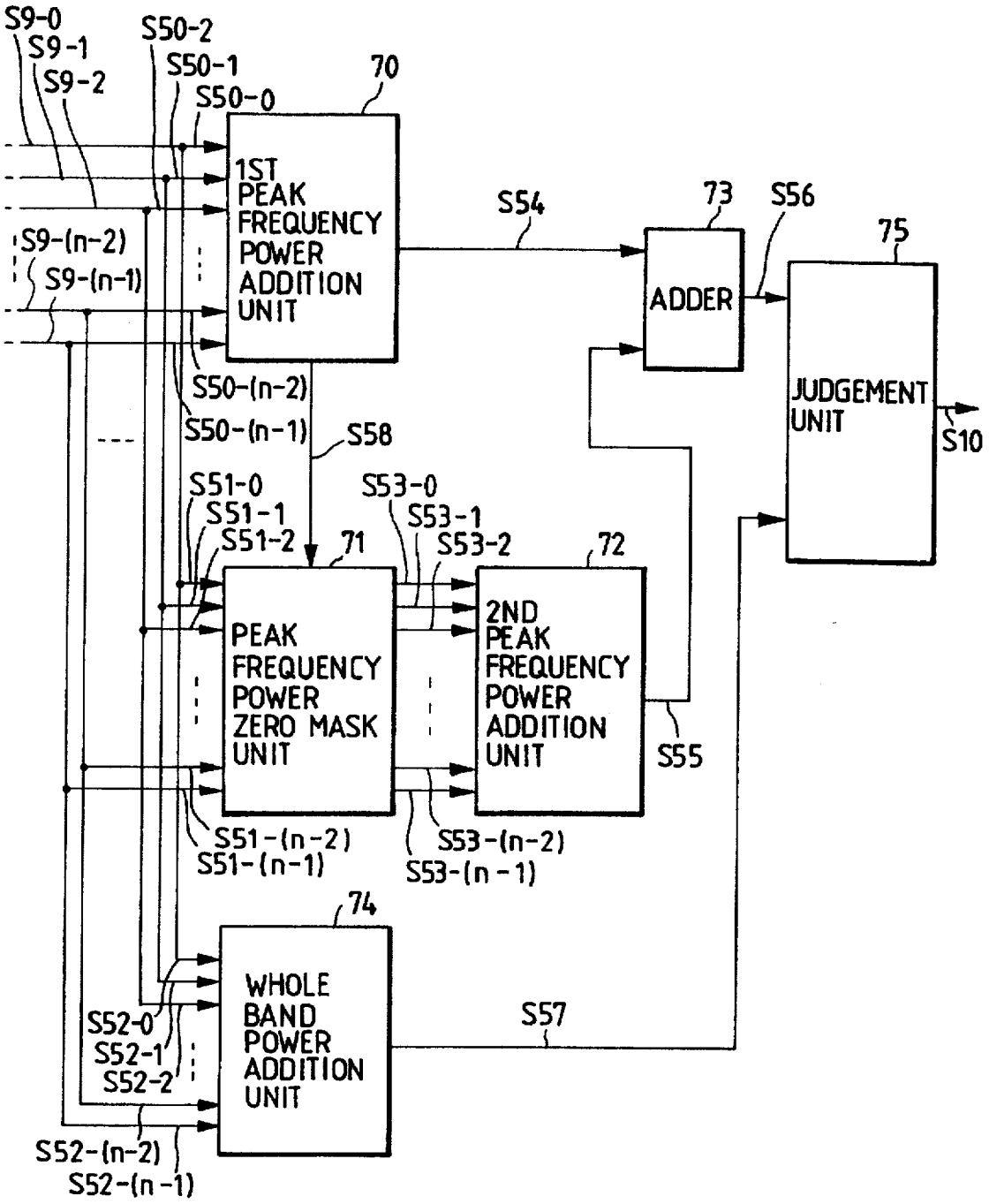
FIG. 12 is a block diagram showing an arrangement of a tone detection unit used in a signal discrimination circuit according to an embodiment 10.

FIG. 12 shows another arrangement of the tone detection unit 52 as an embodiment 10 of the signal discrimination circuit. In FIG. 12, like parts corresponding to those of FIG. 2 are marked with the same references. As shown in FIG. 12, there is provided a first peak frequency power addition unit 70 for receiving the outputs S9-0 to S9-(n−1) and which adds a power value of the frequency band whose power becomes maximum and power values of N frequency bands adjacent to the foregoing frequency band. There is also provided a peak frequency power zero mask unit 71 which forces only the power value of the frequency band whose power value is added by the first peak frequency power addition unit 70 to be set to zero.

There is provided a second peak frequency power addition unit 72 for adding a power value of the frequency band whose power becomes maximum in the outputs of the peak frequency power zero mask unit 71 and power values of N frequency bands adjacent to the foregoing frequency band. There is provided an adder 73 which adds an output S54 of the first peak frequency peak power addition unit 70 and an output S55 of the second peak frequency power addition unit 72. There is provided a whole band power addition unit 74 for adding whole band power values output from the sub-band power calculation unit 51. Further, there is provided a judgement unit 75 for calculating a ratio between the output of the adder 73 and the output of the whole band power addition unit 74 and which determines the presence or absence of the tone signal on the basis of the value of the calculated ratio.

With the above-mentioned arrangement, the outputs S9-0 to S9-(n−1) are input through signal lines S50-0 to S50-(n−1), S51-0 to S51-(n−1) and S52-0 to S52-(n−1) to the first peak frequency power addition unit 70, the peak frequency power zero mask unit 71 and the whole band power addition unit 74. Initially, the first peak frequency power addition unit 70 calculates frequency band whose power value becomes maximum from the sub-band powers S9-0 to S9-(n−1) and adds the power values of the frequency band whose power value becomes maximum and power values of N frequency bands adjacent to the foregoing frequency band. Then, the first peak frequency power addition unit 70 transmits an added value as an output S54. Also, the first peak frequency power addition unit 70 transmits information concerning a frequency band whose power value is added as an output S58. The value of N is determined similarly to the embodiment 1.

The peak frequency power zero mask unit 71 receives the sub-band power values S9-0 to S9-(n−1) and forces only the power value of the frequency band added by the first peak frequency power addition unit 70 to be set to zero (0) on the basis of the output S58 of the first peak frequency power addition unit 70. The peak frequency power zero mask unit 71 does not process power values of other frequency bands, i.e., bypasses the outputs S9-0 to S9-(n−1) of the sub-band power calculation unit 51 and transmits the same as outputs S53-0 to S53-(n−1). The second peak frequency power addition unit 72 receives the outputs S53-0 to S53-(n−1) of the peak frequency power zero mask unit 71 and adds the power value of the frequency band whose power value becomes maximum and power values of N frequency bands adjacent to the foregoing frequency band. Then, the second peak frequency power addition unit 72 outputs an added value S55. The value of N is determined similarly to the case of the above-mentioned first peak frequency power addition unit 70.

The adder 73 adds the output S54 of the first peak frequency power addition unit 70 and the output S55 of the second peak frequency power addition unit 72 and outputs an added value S56. The whole band power addition unit 74 adds all power values S9-0 to S9-(n−1) output from the sub-band power calculation unit 51 and outputs an added value S57. The judgement unit 75 determines on the basis of the output S56 of the adder 73 and the output S57 of the whole band power addition unit 74 within the analysis frame whether or not the input signal is the tone signal. Then, the judgement unit 75 finally determines on the basis of the tone detected results obtained within a plurality of continuous analysis frames whether or not the input signal is the tone signal. The judgement unit 75 transmits a judged result as the output S10.

If the input signal is the single-frequency tone signal, then a frequency spectrum of the signal is concentrated in one frequency band and most powers of the single-frequency tone signal are included in the frequency band in which power values are added by the first peak frequency power addition unit 70. Accordingly, the output S54 of the first peak frequency power addition unit 70 and the output S57 of the whole band power addition unit 74 become substantially equal to each other. Moreover, a sum of the output S54 of the first peak frequency power addition unit 70 and the output S55 of the second peak frequency power addition unit 72 becomes a value nearly equal to the output S57 of the whole band power addition unit 74.

Figure 13:
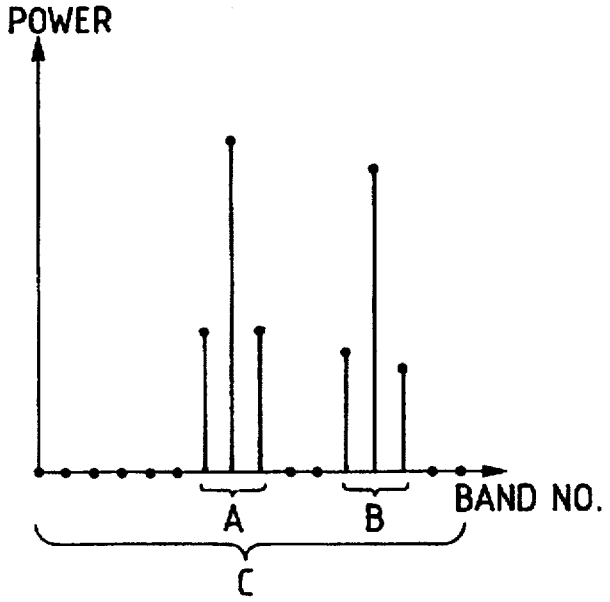
FIG. 13 is a schematic diagram used to explain an operation of the tone detection unit shown in FIG. 12.

If the input signal is the dual-frequency tone signal, then the frequency spectrum of the signal is concentrated on two frequency bands. FIG. 13 shows an operation of the tone detection unit 52 and shows an output obtained from the sub-band power calculation unit 51 when the dual-frequency tone signal is input to this signal discrimination circuit. Most of the powers of the tone signal of one frequency of the dual-frequency tone signal are included in the frequency band in which power values are added by the first peak frequency power addition unit 70 as shown at A in FIG. 13. Most of the powers of the tone signal with the other frequency of the dual-frequency tone signal are included in the frequency band in which power values are added by the second peak frequency power addition unit 72 as shown at B in FIG. 13. Accordingly, a sum of the output S54 of the first peak frequency power addition unit 70 and the output S55 of the second peak frequency power addition unit 72 becomes a value substantially equal to the output S57 of the whole band power addition unit 74 in which power values of the band shown at C in FIG. 13 are added.

If on the other hand the input signal is the voice signal or the voiceband data signal, then the frequency spectrum distribution in such case generally becomes wider than that of the single-frequency tone signal or the dual-frequency tone signal. Therefore, a sum of the output S54 of the first peak frequency power addition unit 70 and the output S55 of the second peak frequency power addition unit 72 becomes smaller than the output S57 of the whole band power addition unit 74. Accordingly, if a relationship expressed by the following equation (7) is established between the output S56 of the adder 73 and the output S57 of the whole band power addition unit 74, it can be determined that the tone signal is detected within the analysis frame. If on the other hand such relationship is not established, it can be determined that the tone signal is not detected within the analysis frame.

$$\frac{\text{output of adder 73}}{\text{output of whole band power addition unit 74}} > Th3 \tag{7}$$

In the above equation (7), reference symbol Th3 depicts a previously-determined threshold value. From the same reason as that in the above-mentioned embodiment 1, it is finally determined on the basis of the tone signal detected results within a plurality of continuous analysis frames whether or not the tone signal is detected. If the tone signal is detected in N10 or more analysis frames out of N9 continuous analysis frames, then the output S10 of the judgement unit 75 is set to the value "1" (tone signal is detected). If not, then the output S10 of the judgement unit 75 is set to the value "0" (tone signal is not detected).

According to the above-mentioned arrangement, when an input signal, such as the single-frequency tone signal or the dual-frequency tone signal in which the frequency spectrum is concentrated on the local portion is supplied, it is possible to detect the single-frequency tone signal and the dual-frequency tone signal by using the feature in which the ratio of the value which results from adding the output S54 of the first peak frequency power addition unit 70 and the output S55 of the second peak frequency power addition unit 72 relative to the output S57 of the whole band power addition unit 74 is increased.

Embodiment 11

Figure 14:
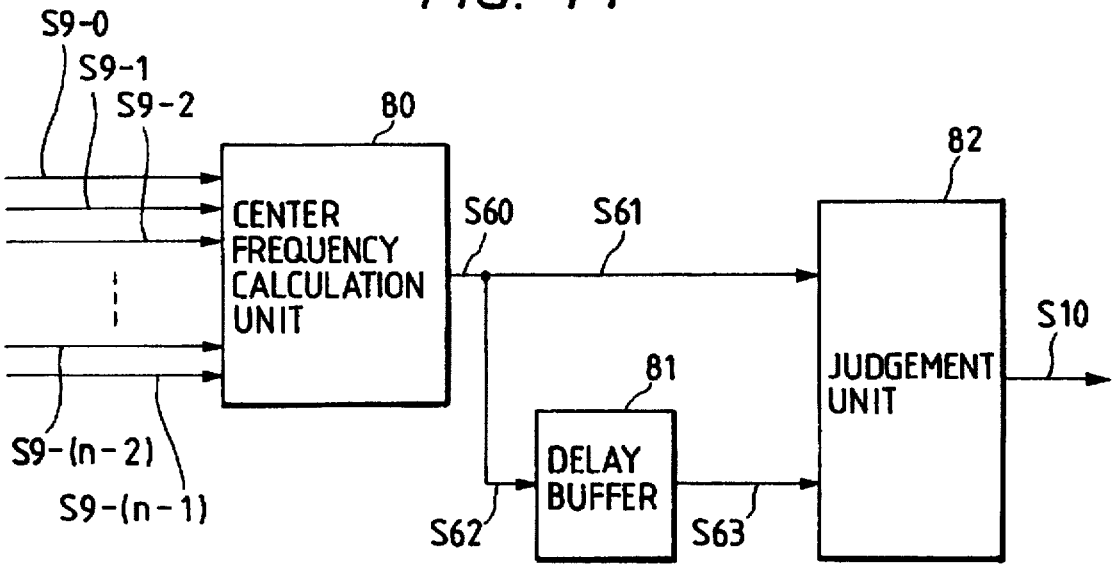
FIG. 14 is a block diagram showing an arrangement of a tone detection unit used in a signal discrimination circuit according to an embodiment 11.

FIG. 14 shows other arrangement of the tone detection unit 52 as an embodiment 11 of the signal discrimination circuit. As shown in FIG. 14, there is provided a center frequency calculation unit 80 which calculates a mean value of a frequency spectrum distribution of the input signal from the outputs S9-0 to S9-(n−1) of the sub-band power calculation unit 51. There is provided a delay buffer 81 which delays an output S60 of the center frequency calculation unit 80 by a delay amount of one analysis frame. Further, there is provided a judgement unit 82 which judges the presence or absence of the tone signal on the basis of the output of the center frequency calculation unit 80 and the output of the delay buffer 81.

The center frequency calculation unit 80 calculates from the powers S9-0 to S9-(n−1) (P[0], P[1], P[2], . . . , P[n−2], P[n−1]) a center frequency Fm defined by the following equation (8):

$$Fm = \sum_{k=0}^{n-1} \{k \times P[k]\} / \sum_{k=0}^{n-1} P[k] \tag{8}$$

Then, the center frequency calculation unit 80 transmits the value of this center frequency Fm as the output S60. The value of this center frequency Fm is input through signal lines S61, S62 to the judgement unit 82 and the delay buffer 81, respectively. If the input signal is the periodic signal, such as the single-frequency tone signal or the dual-frequency tone signal, then a fluctuation of the frequency spectrum is small so that the fluctuation of the value of the center frequency Fm expressed by the above equation (8) is decreased with a time. If on the other hand the input signal is the voice signal or the voiceband data signal, then the fluctuation of the value of the center frequency Fm is increased with a time.

The delay buffer 81 delays the output S60 of the center frequency calculation unit 80 by a delay amount of one analysis frame and transmits a delayed value as an output S63. The judgement unit 82 determines on the basis of the output S60 of the center frequency calculation unit 80 and the output S63 of the delay buffer 81 within the analysis frame whether or not the input signal is the tone signal. Then, the judgement unit 82 finally determines by using tone signal detected results obtained within a plurality of continuous analysis frames whether or not the input signal is the tone signal. The judgement unit 82 transmits a judged result as the output S10.

The judgement unit 82 initially calculates a difference value between the output S61 of the center frequency calculation unit 80 and the output S63 of the delay buffer 81 and then calculates an absolute value of the thus calculated difference value. This absolute value expresses a magnitude of a time fluctuation of the output S60 of the center frequency calculation unit 80. If the input signal is the single-frequency tone signal or the dual-frequency tone signal, then this absolute value takes a small value. If on the other hand the input signal is the voice signal or the voiceband data signal, then this absolute value takes a large value. Accordingly, when this absolute value is compared with a certain threshold value, if the absolute value is smaller than this threshold value, then it is determined that the tone signal is detected within the analysis frame. If not, then it is determined that the tone signal is not detected within the analysis frame.

From the same reason as that of the embodiment 1, it is finally determined by using tone signal detected results obtained within a plurality of continuous analysis frames whether or not the tone signal is detected. If the tone signal is detected in N12 or more analysis frames out of N11 continuous analysis frames, then the output S10 of the judgement unit 82 is set to the value "1" (tone signal is detected). If not, then the output S10 of the judgement unit 82 is set to the value "0" (tone signal is not detected).

According to the above-mentioned arrangement, when the input signal, such as the single-frequency tone signal or the dual-frequency tone signal in which a fluctuation of a frequency spectrum is small is supplied, it is possible to detect the single-frequency tone signal and the dual-frequency tone signal by using the feature in which a time fluctuation of the output S61 of the center frequency calculation unit 80 becomes small.

Embodiment 12

Figure 15:
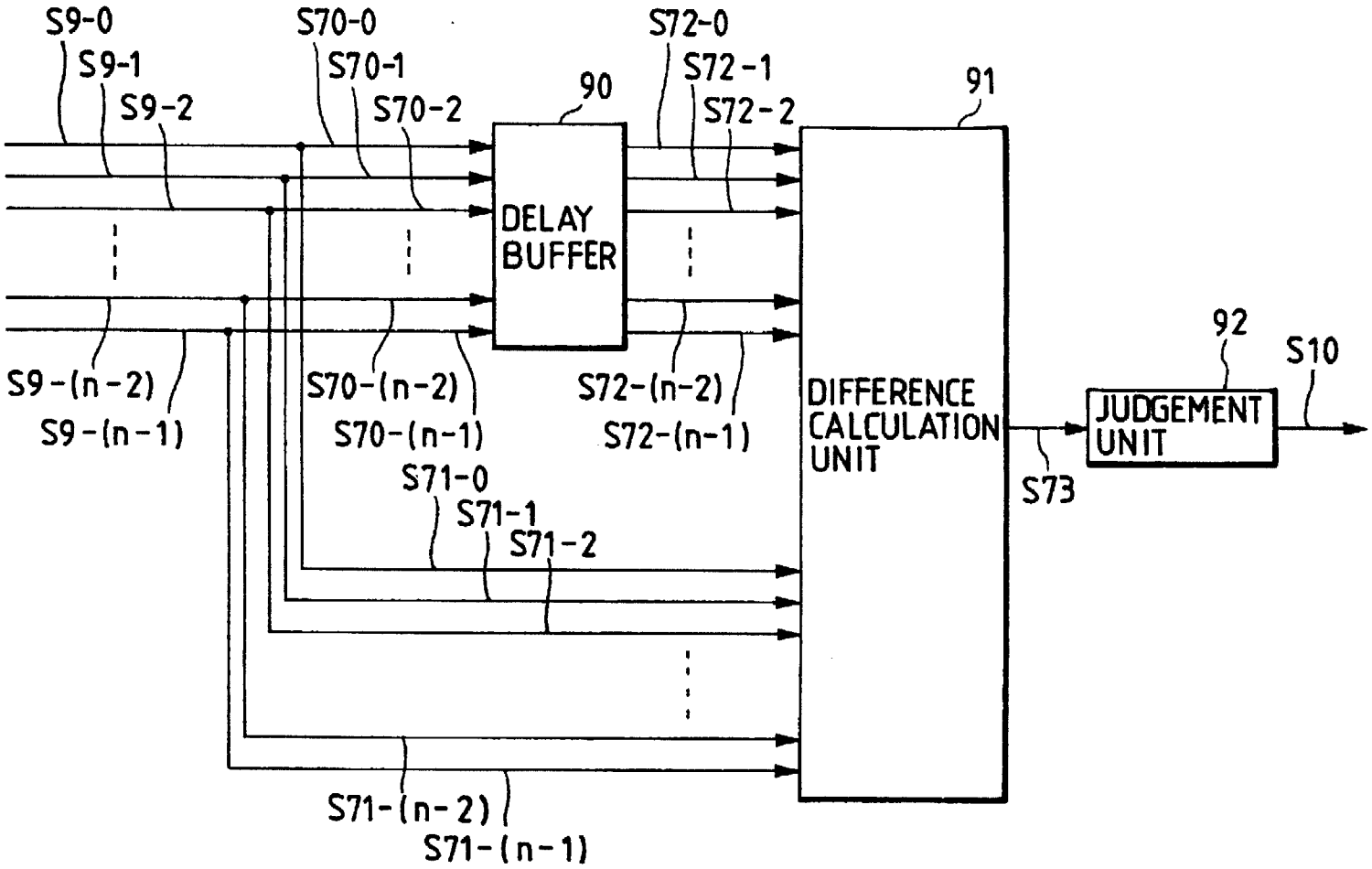
FIG. 15 is a block diagram showing an arrangement of a tone detection unit used in a signal discrimination circuit according to an embodiment 12.

FIG. 15 shows another arrangement of the tone detection circuit 52 as the embodiment 12 of the signal discrimination circuit. There is provided a delay buffer 90 which delays the outputs S9-0 to S9-(n−1) input thereto from the sub-band power calculation unit 51 through signal lines S70-0 to S70-(n−1) by a delay amount of one analysis frame. There is provided a difference calculation unit 91 which calculates a difference between the outputs S9-0 to S9-(n−1) supplied thereto from the sub-band power calculation unit 51 through signal lines S71-0 to S71-(n−1) and outputs S72-0 to S72-(n−1) of the delay buffer 90. Further, there is provided a judgement unit 92 which judges the presence or absence of the tone signal on the basis of an output S73 of the difference calculation unit 91.

According to the above-mentioned arrangement, the outputs S9-0 to S9-(n−1) of the sub-band power calculation unit 51 are input through the signal lines S70-0 to S70-(n−1) and S71-0 to S71-(n−1) to the delay buffer 90 and the difference calculation unit 91. The delay buffer 90 delays the outputs S9-0 to S9-(n−1) of the sub-band power calculation unit 51 by the delay amount of one analysis frame. Here, let it be assumed that Q[0], Q[1]. Q[2], . . . , Q[n−2], Q[n−1] are outputs S72-0, S72-1, S72-2, . . . , S72-(n−2), S72-(n−1) of the delay buffer 90 corresponding to the powers S9-0, S9-1, 9-2, S9-(n−2), S9-(n−1) (the above-mentioned powers P[0], P[1], P[2], . . . , P[n−2], P[n−1]), respectively.

Initially, the difference calculation unit 91 calculates on the basis of the following equation (9):

$$S[k]=|P[k]-Q[k]| \tag{9}$$

where k=0, 1, 2, . . . , n−1 difference values S[0], S[1], S[2], . . . , S[n−1] between the outputs P[0], P[1], P[2], . . . , P[n−2], P[n−1] of the sub-band power calculation unit 51 and the outputs Q[0], Q[1], Q[2], . . . , Q[n−2], Q[n−1] of the delay buffer 90 at every band. The difference calculation unit 91 adds the difference values thus calculated at every band as shown by the following equation (10):

$$\text{output of difference calculation unit 91} = \sum_{n-1}^{k=0} S[k] \tag{10}$$

The added value is used as the output S73 of the difference calculation unit 91. If the input signal is the periodic signal, such as the single-frequency tone signal or the dual-frequency tone signal, then a fluctuation of the frequency spectrum is small so that the output S73 of this difference calculation unit 91 becomes small. If on the other hand the input signal is the voice signal or the data band data signal, then the output S73 of this difference calculation unit 91 becomes a large value.

The judgement unit 92 determines on the basis of the output S73 of the difference calculation unit 91 within the analysis frame whether or not the input signal is the tone signal. Then, the judgement unit 92 finally determines by using tone signal detected results obtained when a plurality of analysis frames whether or not the tone signal is detected. The judgement unit 92 then transmits a judged result as the output S10. The judgement unit 92 compares the output S73 of the difference calculation unit 91 and a certain threshold value with each other. When the output S73 of the difference calculation unit 91 is smaller than the threshold value, the judgement unit 92 judges that the tone signal is detected within the analysis frame. When the output S73 is not smaller than the threshold value, the judgement unit 92 determines that the tone signal is not detected within the analysis frame.

From the same reason as that in the embodiment 1, it is finally determined by using tone signal detected results obtained within a plurality of continuous analysis frames whether or not the tone signal is detected. If the tone signal is detected in N14 or more analysis frames out of continuous N13 analysis frames, then the output S10 of the judgement unit 92 is set to the value "1" (tone signal is detected). If not, then the output S10 of the judgement unit 92 is set to the value "0" (tone signal is not detected).

According to the above-mentioned arrangement, if the input signal, such as the single-frequency tone signal or the dual-frequency tone signal in which the fluctuation of the frequency spectrum is small is supplied, then the output S73 of the difference calculation unit 91 becomes small. Therefore, it is possible to detect the single-frequency tone signal and the dual-frequency tone signal by comparing the output S73 of the difference calculation unit 91 and a certain threshold value by the judgement unit 92.

Embodiment 13

Figure 16:
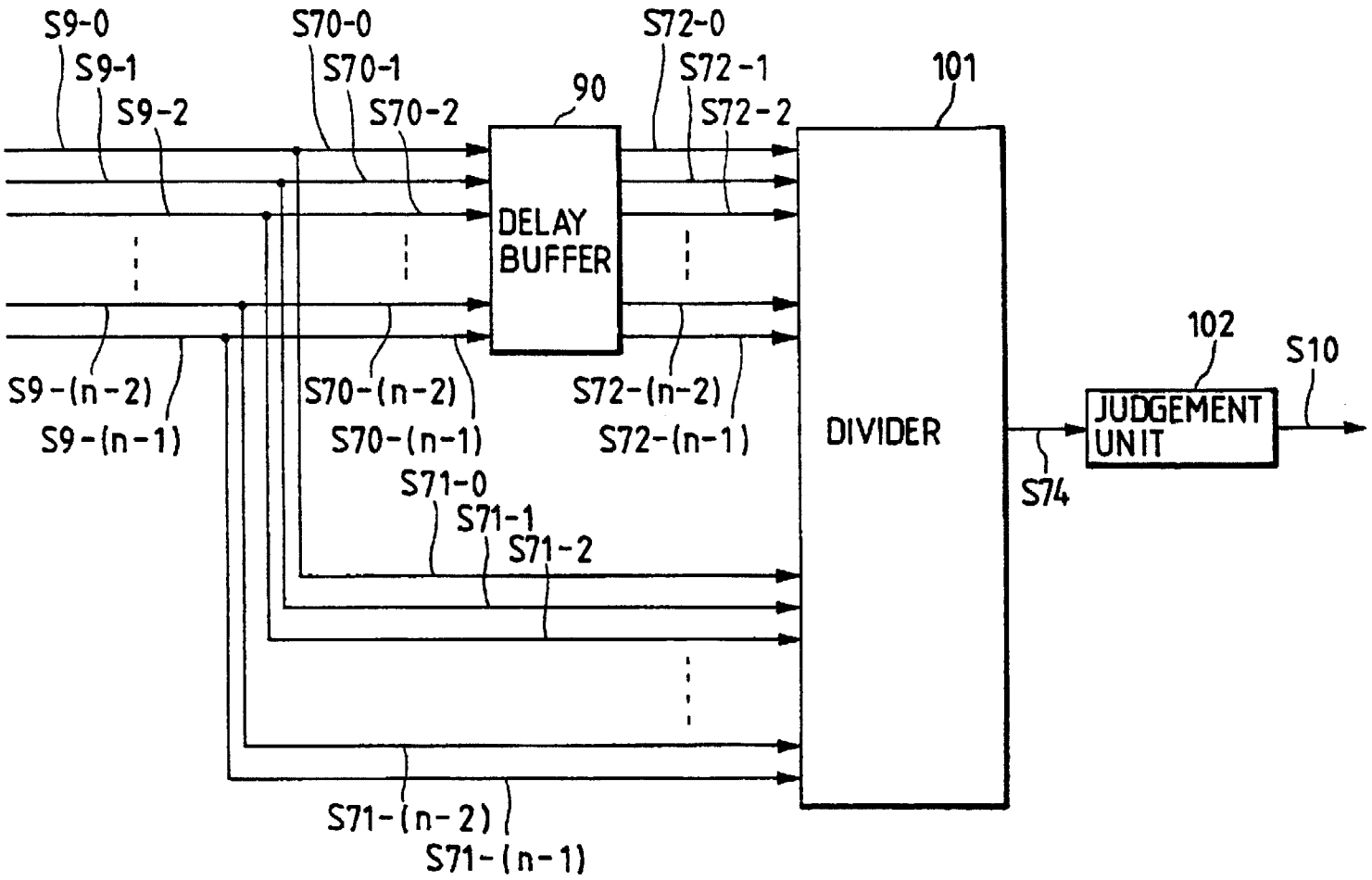
FIG. 16 is a block diagram showing an arrangement of a tone detection unit used in a signal discrimination circuit according to an embodiment 13.

FIG. 16 shows another arrangement of the tone detection unit 52 as an embodiment 13 of the signal discrimination circuit. In FIG. 16, like parts corresponding to those of FIG. 15 are marked with the same references. As shown in FIG. 16, there is provided a divider 101 which calculates a ratio between the outputs S9-0 to S9-(n−1) of the sub-band power calculation unit 51 and the outputs S72-0 to S72-(n−1) of the delay buffer 90. There is provided a judgement unit 102 which judges the presence or absence of the tone signal on the basis of an output S74 of the divider 101. The outputs S9-0 to S9-(n−1) of the sub-band power calculation unit 51 are input through the signal lines S70-0 to S70-(n−1) and S71-0 to S71-(n−1) to the delay buffer 90 and the divider 101, respectively.

An operation of the delay buffer 90 is the same as that of the embodiment 12. The divider 101 compares the power values S71-0 to S71-(n−1) (i.e., P[0], P[1], P[2], . . . , P[n−2], P[n−1]) of the frequency bands output from the sub-band power calculation unit 51 and the outputs S72-0 to S72-(n−1) (i.e., Q[0], Q[1], Q[2], . . . , Q[n−2], Q[n−1]) of the delay buffer 90.

Then, on the basis of the following equation (11):

$$R[k] = \begin{cases} P[k]/Q[k] & (\text{when } P[k] \geq Q[k]) \\ Q[k]/P[k] & (\text{when } P[k] \leq Q[k]) \end{cases} \tag{11}$$

where $k = 0, 1, 2, \ldots, n-1$ the divider 101 calculates ratios (R[0], R[1], R[2], . . . , R[n−2], R[n−1]) between the two outputs at every frequency band.

As shown on the following equation (12), $$\text{Output of divider 101} = \sum_{k=0}^{n-1} R[k] \tag{12}$$

The values of the ratios thus calculated at every frequency band are added and the added value is used as the output S74 of the divider 101. If the input signal is the periodic signal, such as the single-frequency tone signal or the dual-frequency tone signal, then the fluctuation of the frequency spectrum is small so that the output S74 of the divider 101 becomes a small value. If on the other hand the input signal is the voice signal or the voiceband data signal, then the output S74 of the divider 101 becomes a large value.

The judgement unit 102 determines within the analysis frame on the basis of the output S74 of the divider 101 whether or not the input signal is the tone signal. Then, the judgement unit 102 finally determines by using tone signal detected results obtained within a plurality of continuous analysis frames whether or not the tone signal is detected. The judgement unit 102 then transmits a judged result as the output S10. In actual practice, the judgement unit 102 initially compares the output S74 of the divider 101 with a certain threshold value. If the output S74 of the divider 101 is smaller than the threshold value, then it is determined by the judgement unit 102 that the tone signal is detected within the analysis frame. If the output S74 is not smaller than the threshold value, then it is determined by the judgement unit 102 that the tone signal is not detected within the analysis frame.

From the same reason as that of the embodiment 1, it is finally determined by the judgement unit 102 by using tone signal detected results obtained within a plurality of continuous analysis frames whether or not the tone signal is detected. If the tone signal is detected in N16 or more analysis frames out of continuous N15 analysis frames that the tone signal is detected, then the output S10 of the judgement unit 102 is set to the value "1" (tone signal is detected). If not, then the output S10 of the judgement unit 102 is set to the value "0" (tone signal is not detected).

According to the above-mentioned arrangement, if the input signal, such as the single-frequency tone signal or the dual-frequency tone signal in which the fluctuation of the frequency spectrum is small is supplied, the output S74 of the divider 101 becomes small. Therefore, it is possible to reliably detect the single-frequency tone signal and the dual-frequency tone signal by comparing the output S74 of the divider 101 and a certain threshold value by the judgement unit 102.

Embodiment 14

Figure 17:
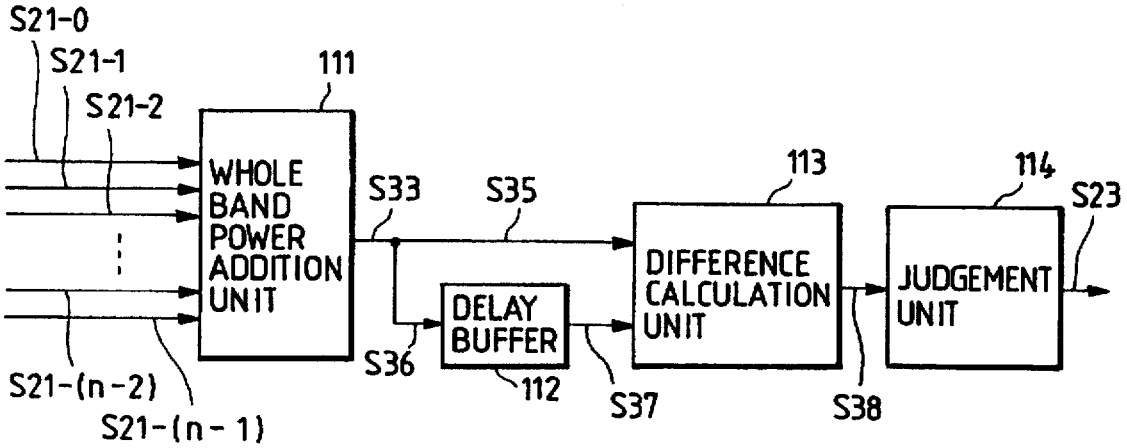
FIG. 17 is a block diagram showing an arrangement of an voice/data discrimination unit used in a signal discrimination circuit according to an embodiment 14.

FIG. 17 shows another arrangement of the voice/data discrimination unit 60 as the embodiment 14 of the signal discrimination circuit. In FIG. 17, like parts corresponding to those of FIG. 5 are marked with the same references. As shown in FIG. 17, there is provided a whole band power addition unit 111 which adds power values of the whole frequency bands output from the sub-band power calculation unit 51. There is provided a delay buffer 112 which delays an output of the whole band power addition unit 111 by a delay amount of one analysis frame. There is provided a difference calculation unit 113 which calculates a difference between the output of the whole band power addition unit 111 and the output of the delay buffer 112. Further, there is provided a judgement unit 114 which determines on the basis of the output from the difference calculation unit 113 whether the input signal is the voice signal or the voiceband data signal.

In the voice/data discrimination unit 60, the whole band power addition unit 111 adds all power values S9-0 to S9-(n−1) output from the sub-band power calculation unit 51 and then outputs the added value S33. This added value S33 is input through the signal lines S35, S36 to the difference calculation unit 113 and the delay buffer 112. The delay buffer 112 delays the output S35 of the whole band power addition unit 111 by the delay amount of one analysis frame and then outputs the thus delayed value S37.

The difference calculation unit 113 calculates a difference value between the output S33 of the whole band power addition unit 111 and the output S37 of the delay buffer 112. Subsequently, the difference calculation unit 113 calculates an absolute value of this difference value and outputs this absolute value S38. As the time fluctuation of the input signal is increased, the output S38 of the difference calculation unit 113 becomes large. Since the time fluctuation of the power of the voice signal is larger than the time fluctuation of the power of the voiceband data signal, if the input signal is the voice signal, then the output S38 of the difference calculation unit 113 becomes large as compared with the case that the input signal is the voiceband data signal.

The judgement unit 114 determines within the analysis frame on the basis of the output S38 of the difference calculation unit 113 whether the input signal is the voice signal or the voiceband data signal. Then, the judgement unit 114 finally determines by using judged results obtained within a plurality of continuous analysis frames whether the input signal is the voice signal or the voiceband data signal. Then, the judgement unit 114 outputs the judged result S23. In actual practice, the judgement unit 114 determines within the analysis frame by using the basis of the output S38 of the difference calculation unit 113 on the basis of the following equation (13) whether the input signal is the voice signal or the voiceband data signal:

$$\text{Output of difference calculation unit 113} \leq \text{Th4} \quad (13)$$

In the above-mentioned equation (13), reference symbol Th4 depicts a previously-determined threshold value.

The time fluctuation of the power of the voiceband data signal is smaller than that of the voice signal. Therefore, if the input signal is the voiceband data signal, then the value on the left-hand side member of the above equation (13) becomes small as compared with the case that the input signal is the voice signal so that the above equation (13) is satisfied, it is determined that the input signal is the voiceband data signal. On the other hand, if the above equation (13) is not satisfied, then it is determined within this analysis frame that the input signal is the voice signal.

Then, it is finally determined by using judged results obtained within a plurality of consecutive analysis frames whether the input signal is the voice signal or the voiceband data signal. If it is determined in N18 or more analysis frames out of continuous N17 analysis frames that the input signal is the voice signal, then the output S23 of the judgement unit 114 is set to the value "0" (voice signal). If on the other hand it is determined in N20 or more analysis frames out of consecutive N19 analysis frames that the input signal is the voiceband data signal, the output S23 of the judgement unit 114 is set to the value "1" (voiceband data signal). If it is determined that the input signal is neither the voice signal nor the voiceband data signal, then the output S23 of the judgement unit 114 is held in the previous state.

According to the above-mentioned arrangement, when the input signal, such as the voice signal in which the time fluctuation of the power is large is supplied, the output S38 of the difference calculation unit 113 becomes large. Therefore, it is possible to determine by comparing the output S38 of the difference calculation unit 113 with a certain threshold value by the judgement unit 114 whether the input signal is the voice signal or the voiceband data signal.

Embodiment 15

Figure 18:
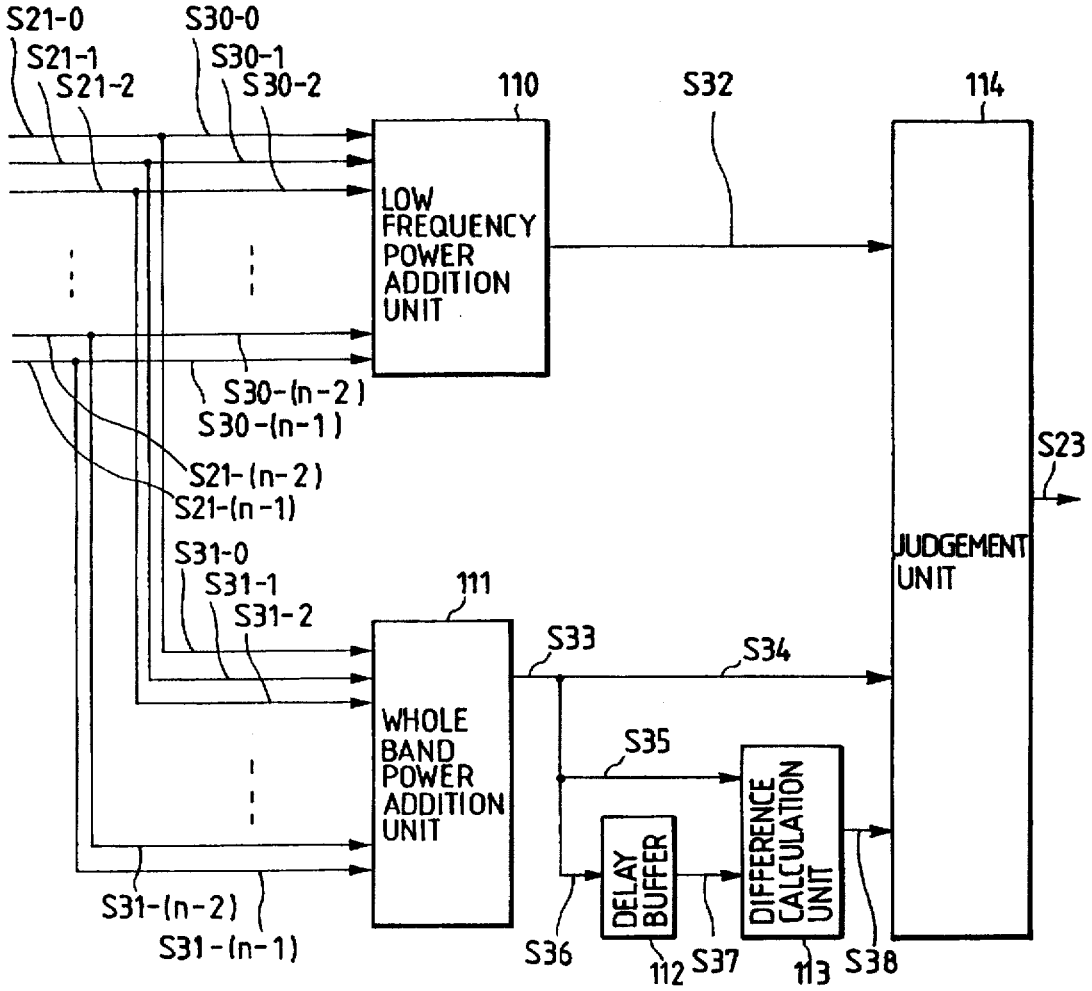
FIG. 18 is a block diagram showing an arrangement of an voice/data discrimination unit used in a signal discrimination circuit according to an embodiment 15.

FIG. 18 shows another arrangement of the voice/data discrimination unit 60 as the embodiment 15 of the signal discrimination circuit. In FIG. 18, like parts corresponding to those of FIGS. 5 and 17 are marked with the same references. As shown in FIG. 18, there is provided the judgement unit 114 which determines on the basis of the outputs S32, S33 and S38 of the low frequency power addition unit 110, the whole band power addition unit 111 and the difference calculation unit 113 whether the input signal is the voice signal or the voiceband data signal.

In the voice/data discrimination unit 60, the input signals S9-0 to S9-(n−1) are input through the signal lines S21-0 to S21-(n−1) and S30-0 to S30-(n−1), S21-0 to S21-(n−1) and S31-0 to S31-(n−1) to the low frequency power addition unit 110 and the whole band power addition unit 111, respectively. Operations of the low frequency power addition unit 110 and the whole power addition unit 111 are the same as those of the aforesaid embodiment 2. Moreover, operations of the delay buffer 112 and the difference calculation unit 113 are the same as those of the aforesaid embodiment 14.

The judgement unit 114 determines within the analysis frame on the basis of the outputs S32, S33, S38 of the low frequency power addition unit 110, the whole band power addition unit 111 and the difference calculation unit 113 whether the input signal is the voice signal or the voiceband data signal. Also, the judgement unit 114 finally determines by using judged results obtained within a plurality of analysis frames whether the input signal is the voice signal or the voiceband data signal. Then, the judgement unit 114 transmits a judged result as the output S23.

Initially, the judgement unit 114 calculates a ratio between the output S32 of the low frequency power addition unit 110 and the output S33 of the whole band power addition unit 111.

Then, the judgement unit 114 determines within the analysis frame on the basis of the following equation (14) whether or not the input signal is the voice signal.

$$\frac{\text{Output of low frequency power addition unit 110}}{\text{Output of whole band power addition unit 111}} > Th5 \quad (14)$$

Incidentally, in the above equation (14), reference symbol Th5 depicts a previously-determined threshold value. The value of the threshold value Th5 may be either equal to or different from the value of Th2 in the aforesaid equation (6) of the embodiment 2.

If the input signal is the voice signal, then the value on the left-hand side member of the equation (14) becomes large as compared with the case that the input signal is the voiceband data signal so that, when the equation (14) is satisfied, it can be determined within this analysis frame that the input signal is the voice signal. On the other hand, when the equation (14) is not satisfied, there is then the large possibility that the input signal will be the voiceband data signal. But the frequency spectrum of the voice signal has a relatively large fluctuation. So there is then the possibility that the above-mentioned equation (14) is not satisfied depending on the value of Th5 even when the input signal is the voice signal. Accordingly, a condition under which it is detected that the input signal is the voiceband data signal is determined separately.

The judgement unit 114 determines within an analysis frame by using the ratio between the output S32 of the low frequency power addition unit 110 and the output S33 of the whole band power addition unit 111 and the output S38 of the difference calculation unit 113 on the basis of the following equation (15) whether or not the input signal is the voiceband data signal.

$$\frac{\text{Output of low frequency power addition unit 110}}{\text{Output of whole band power addition unit 111}} \leq Th6 \quad (15)$$

Also, the judgement unit 114 carries out the above-mentioned processing by using the following equation (16):

$$\text{Output of difference calculation unit 113} \leq Th7 \quad (16)$$

In the above-mentioned equations (15) and (16), reference symbols Th6 and Th7 are previously-determined threshold values. The value of the threshold value Th6 may be either equal to or different from the value of the threshold value Th2 used in the equation (6) of the embodiment 2. Further, the value of the threshold value Th7 may be either equal to or different from the value of the threshold value Th4 used in the equation (13) of the embodiment 14. Moreover, the value of the threshold value Th6 may be either equal to or different from the value of the threshold value Th5 used in the equation (14).

If the input signal is the voiceband data signal, then the value on the left-hand side member on the equation (15) becomes smaller as compared with the case that the input signal is the voice signal. Therefore, if the above-mentioned equation (15) is satisfied, there is then the large possibility that the input signal will be the voiceband data signal. Also, since the power of the voiceband data signal has a small time fluctuation as compared with the power of the voice signal, if the input signal is the voiceband data signal, then the value of the left-hand side member on the above equation (16) becomes small as compared with the case that the input signal is the voice signal. Therefore, if the equation (16) is satisfied, there is then the large possibility that the input signal will be the voiceband data signal. Thus, If the above-mentioned equations (15) and (16) are satisfied simultaneously, then it can be determined within this analysis frame that the input signal is the voiceband data signal.

If on the other hand any one of the above equations (15) and (16) is not satisfied, there is then the large possibility that the input signal will be the voice signal. But even when the input signal is the voiceband data signal, if the modulation system of MODEM is changed, there is then the possibility that neither of the above equations (15) and (16) will be satisfied depending on the values of the threshold values Th6 and Th7. Accordingly, the conditions on the above-mentioned equations (15) and (16) are not the conditions under which it can be detected that the input signal is the voice signal.

Then, it is finally determined by using judged results obtained within a plurality of continuous analysis frames whether the input signal is the voice signal or the voiceband data signal. If it is determined in N22 or more analysis frames out of continuous N21 analysis frames that the input signal is the voice signal, then the output S23 of the judgement unit 114 is set to the value "0" (voice signal).

Further, if it is determined in N24 or more analysis frames out of continuous N23 analysis frames that the input signal is the voiceband data signal, then the output S23 of the judgement unit 114 is set to the value "1" (voiceband data signal). If it is determined that the input signal is neither the voice signal nor the voiceband data signal, then the output S23 of the judgement unit 114 is held in the previous state.

According to the above-mentioned arrangement, it is possible to discriminate the voice signal and the voiceband data signal with a high accuracy by using the feature in which the ratio of the output S32 of the lower frequency power addition unit 110 relative to the output S34 of the whole band power addition unit 111 is increased when the input signal, such as the voice signal in which a power distribution is concentrated on the low frequency band is supplied and the feature in which the output S38 of the difference calculation unit 113 is increased when the input signal, such as the voice signal of which the time fluctuation of power is large is supplied.

Embodiment 16

Figure 19:
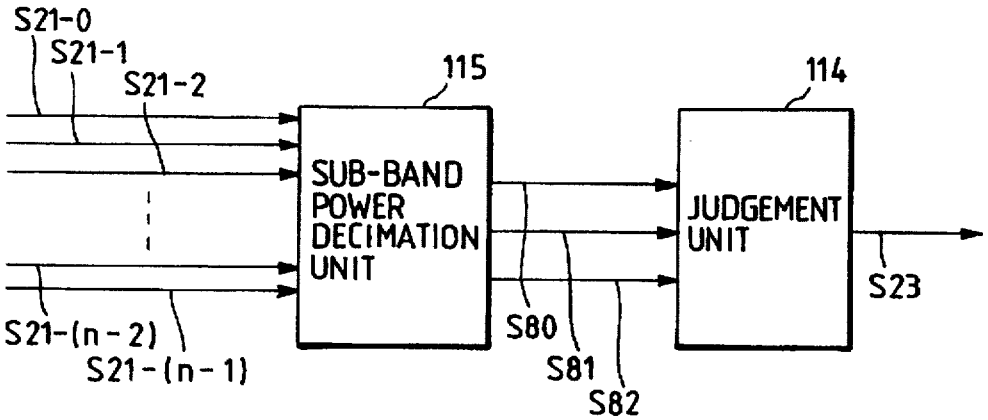
FIG. 19 is a block diagram showing an arrangement of an voice/data discrimination unit used in a signal discrimination circuit according to an embodiment 16.

FIG. 19 shows another arrangement of the voice/data discrimination unit 60 as the embodiment 16 of the signal discrimination circuit. In FIG. 19, like parts corresponding to those of FIG. 18 are marked with the same references. As shown in FIG. 19, there is provided a sub-band power decimation unit 115 which selects the low frequency band, the middle frequency band and the high frequency band from the sub-band power values output from the sub-band power calculation unit 51 and outputs power values of these frequency bands. There is provided the judgement unit 114 which determines on the basis of the output of the sub-band power decimation unit 115 whether the input signal is the voice signal or the voiceband data signal.

In this voice/data discrimination unit 60, the sub-band power decimation unit 115 selects the frequency bands typically representing the low frequency, the middle frequency and the high frequency respectively from the sub-band power values S9-0 to S9-(n−1) output from the sub-band power calculation unit 51. Then, the sub-band power decimation unit 115 transmits a power value of the low frequency band signal as an output S80, a power value of the middle frequency band signal as an output S81 and a power value of the high frequency band signal as an output S82.

Figure 20A:
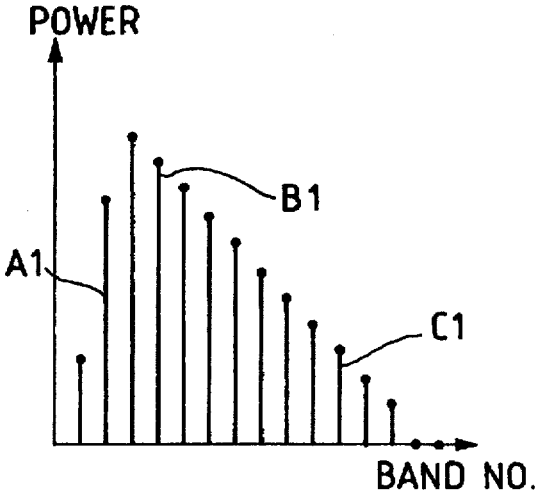
FIGS. 20A through 20D are schematic diagrams used to explain an operation of a sub-band power decimation unit in the voice/data discrimination unit shown in FIG. 19.
Figure 20C:
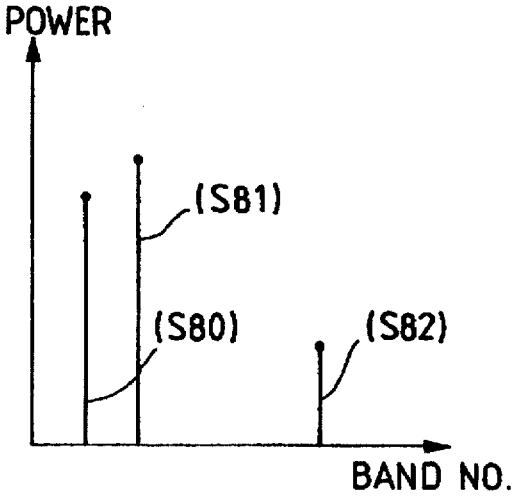
Figure 20B:
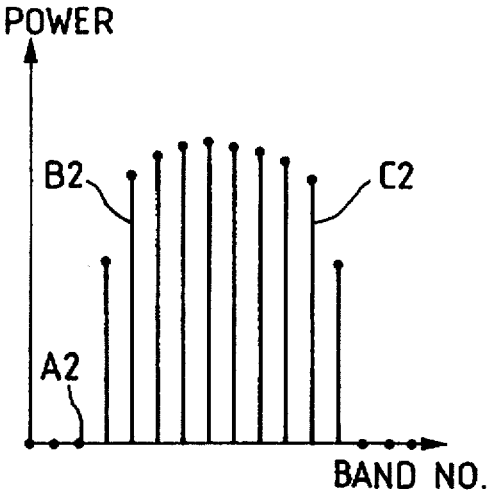
Figure 20D:
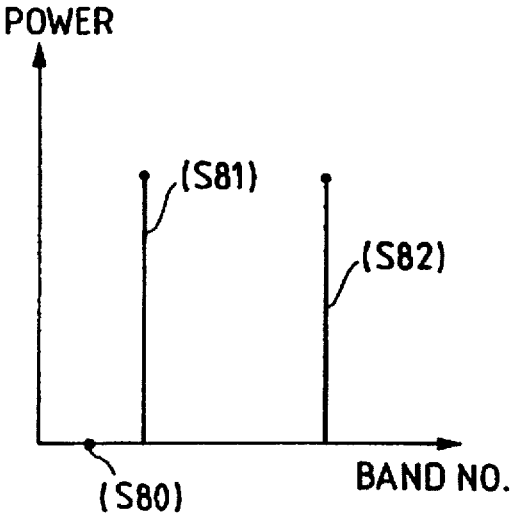
Figure 21:
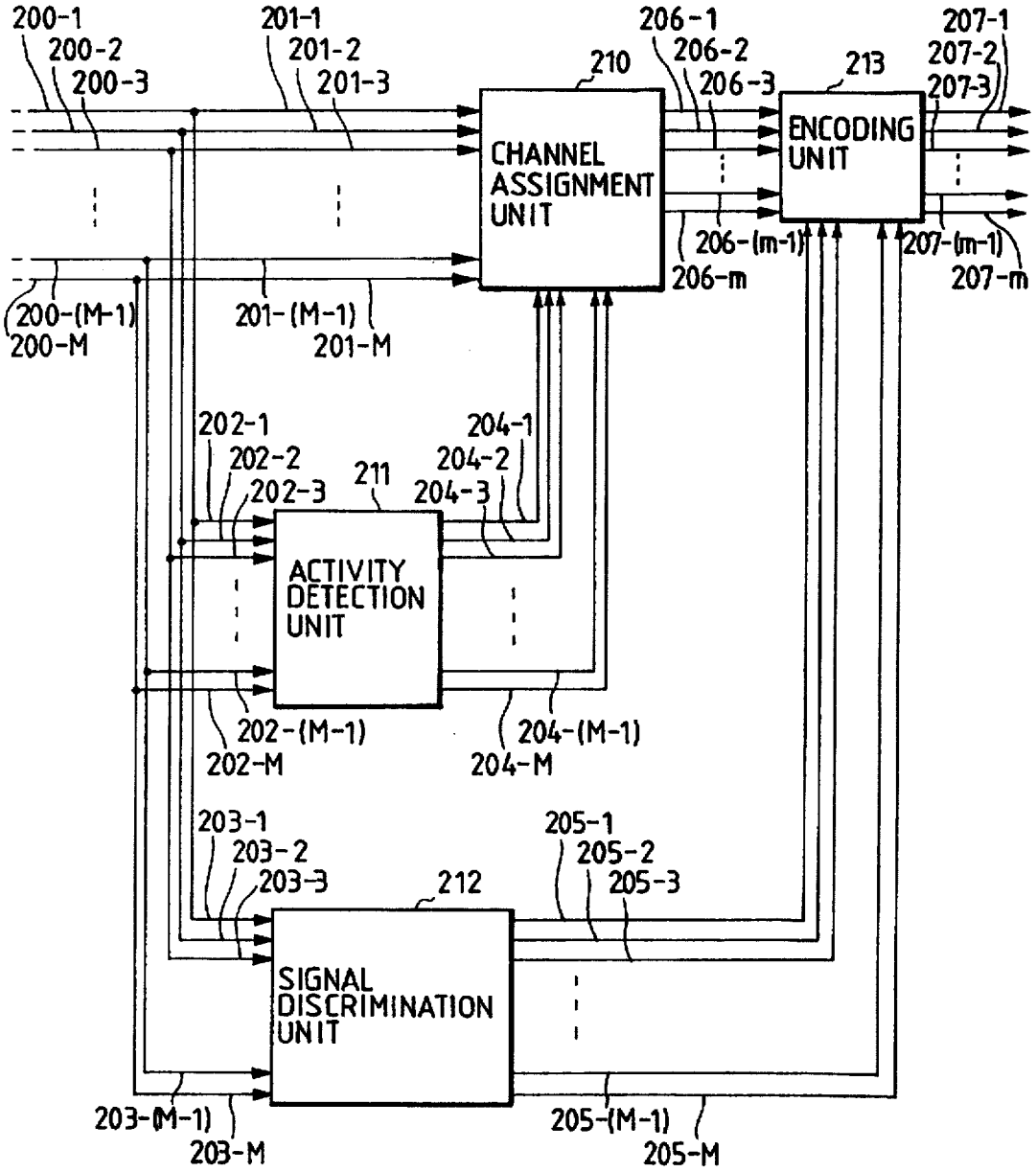
FIG. 21 is a block diagram showing an overall arrangement of a DCME which uses a signal discrimination circuit.

FIGS. 20A through 20D are schematic diagrams used to explain operation of the sub-band power decimation unit 115. FIG. 20A shows the outputs S9-0 to S9-(n−1) supplied thereto from the sub-band power calculation unit 51 when the voice signal is input to the signal discrimination circuit. FIG. 20B shows the outputs S9-0 to S9-(n−1) supplied thereto from the sub-band power calculation unit 51 when the voiceband data signal is input to the signal discrimination circuit. FIG. 20C shows the outputs S80, S81, S82 supplied thereto from the sub-band power decimation unit 115 when the voice signal is input to the signal discrimination circuit. FIG. 20D shows the outputs S80, S81, S82 supplied thereto from the sub-band power decimation unit 115 when the voiceband data signal is input to the signal discrimination circuit.

At the low frequency band signal, there is selected a frequency band signal in which a power value is sufficiently small in the voiceband data signal and a power value is sufficiently large in the voice signal as shown at A1, A2 in FIGS. 20A and 20B. As the middle frequency band signal, there is selected a frequency band signal in which a frequency is as low as possible on the portion in which the power spectrum of the voiceband data signal is flat as shown at B1, B2 in FIGS. 20A and 20B. Furthermore, as the high frequency band signal, there is selected a frequency band signal in which a frequency is as high as possible on the portion in which the power spectrum of the voiceband data signal is flat as shown at C1, C2 in FIGS. 20A and 20B.

It is determined in the decision unit 114 on the basis of the power values S80, S81, S82 of the respective frequency bands of the low, middle and high frequency bands output from the sub-band power decimation unit 115 within the analysis frame whether the input signal is the voice signal or the voiceband data signal. Then, the decision unit 114 finally determines by using those judged results obtained within a plurality of continuous analysis frames whether the input signal is the voice signal or the voiceband data signal. The decision unit 114 transmits the finally judged result as the output S23.

It is determined in the decision unit 114 by using the power values S80, S81, S82 of the respective frequency bands of the low frequency band, the middle frequency band and the high frequency band within the analysis frame on the basis of the following equations (17), (18) and (19) whether the input signal is the voice signal or the voiceband data signal.

$$\text{Power value S80 of low frequency band} > \text{Th8} \quad (17)$$

$$\text{Power value S82 of high frequency band} < \text{Th9} \quad (18)$$

$$|(\text{power value S82}) - (\text{power value S81 of middle band})| > \text{Th10} \quad (19)$$

In the above-mentioned equations (17), (18) and (19), Th8, Th9 and Th10 are the previously-determined threshold values, respectively.

As shown in FIGS. 20A through 20D, the power distribution of the voice signal is spread over the low frequency band component as compared with that of the voiceband data signal. As a result, the power value S80 of the low frequency band signal becomes small in the voiceband data signal and becomes large in the voice signal. Therefore, if the above equation (17) is satisfied, there is then the large possibility that the input signal will be the voice signal within this analysis frame. If on the other hand the above equation (17) is not satisfied, there is then the large possibility that the input signal will be the voiceband data signal within this analysis frame. Moreover, a power value of a high frequency band component of the voice signal is small as compared with that of the voiceband data signal. As a result, the power value S82 of the high frequency band signal becomes large in the voiceband data signal and becomes small in the voice signal. Therefore, if the above equation (18) is satisfied, there is then the large possibility that the input signal will be the voice signal in this analysis frame. If on the other hand the above equation (18) is not satisfied, there is then the large possibility that the input signal will be the voiceband data signal within this analysis frame.

Furthermore, the voiceband data signal has a flat power spectrum as compared with the voice signal. As a result, the difference between the power value S82 of the high band frequency signal and the power value S81 of the middle band frequency signal becomes small in the voiceband data signal and becomes large in the voice signal. Therefore, if the above equation (19) is satisfied, there is then the large possibility that the input signal will be the voice signal within this analysis frame. If on the other hand the above equation (19) is not satisfied, there is then the large possibility that the input signal will be the voiceband data signal within this analysis frame. Accordingly, if two or more equations of the three equations shown on the above-mentioned equations (17), (18) and (19) are satisfied, then it is determined within this analysis frame that the input signal is the voice signal. If one or less of the above-mentioned equations (17), (18) and (19) is satisfied, then it is determined within this analysis frame that the input signal is the voiceband data signal.

Subsequently, it is finally determined by using those judged results obtained in a plurality of continuous analysis frames whether the input signal is the voice signal or the voiceband data signal. If it is determined in N26 or more analysis frames out of continuous N25 analysis frames that the input signal is the voice signal, then the output S23 of the judgement unit 114 is set to the value "0" (voice signal). If it is determined in N26 or more analysis frames out of continuous N25 analysis frames that the input signal is the voiceband data signal, then the output S23 of the judgement unit 114 is set to the value "1" (voiceband data signal). If it is determined that the input signal is neither the voice signal nor the voiceband data signal, then the output S23 of the judgement unit 114 is held in the previous state.

According to the above-mentioned arrangement, the voice/data discrimination processing is carried out by using frequency bands typically representing the low frequency band, the middle frequency band and the high frequency band of the sub-band power values output from the sub-band power calculation unit 51 so that, it is possible to reliably classify various types of signals including tone signal into voice signal or voiceband data signal with a high accuracy by the simple arrangement.

As described above, according to the present invention, since the operation of the discriminated result output unit which determines on the basis of the judged result based on the interblock electric power ratio of the input signal and the judged result based on the zero-crossing number whether the input signal is the voice signal or the voiceband data signal is controlled by the output from the tone detection unit which calculates the sub-band power values by analyzing the input signal by the spectrum analyzer to thereby judge the presence or absence of the tone signal, the tone signal can be reliably classified into the voice signal when the tone signal is input to the signal discrimination circuit. Thus, it is possible to realize the signal discrimination circuit which can reliably classify various types of signals including tone signal into voice signal or voiceband data signal with a high accuracy.

According to another aspect of the present invention, the sub-band power values are calculated by analyzing the input signal by the spectrum analyzer. Then, the presence or absence of the tone signal is judged on the basis of the sub-band power values. It is determined on the basis of the sub-band power values whether the input signal is the voice signal or the voiceband data signal. Also, it is determined on the basis of the tone signal detected result and the voice/data discriminated result whether the input signal is the voice signal or the voiceband data signal. Therefore, it is possible to realize the signal discrimination circuit of the simple arrangement in which the judgements based on the interblock electric power ratio and the zero-crossing number are not carried out and which can reliably classify various types of signals including tone signal into voice signal or voiceband data signal with a high accuracy.

According to another aspect of the present invention, the call connection or the call disconnection is detected on the basis of the state of the signalling signal. The reset signal is generated when the call connection or the call disconnection is detected. Then, the discriminated state can be output as the voice signal in response to the reset signal, whereby the initial state of the output from the signal discrimination circuit obtained when the telephone communication is started can be set to the voice signal. Therefore, it is possible to realize the signal discrimination circuit which can reliably classify various types of signals including tone signal into voice signal or voiceband data signal with a high accuracy.

According to another aspect of the present invention, when the tone signal is detected, the presence or absence of the 2100 [Hz] tone signal is detected in response to the power value of the frequency band closest to 2100 [Hz] of the sub-band power values. Then, when the 2100 [Hz] tone signal is detected, the discriminated state can be output as the voiceband data signal. Therefore, the 2100 [Hz] tone signal, which is used as the MODEM communication procedure, can be classified into the voiceband data signal reliably. Thus, it is possible to realize the signal discrimination circuit which can reliably classify various types of signals including tone signal into voice signal or voiceband data signal with a high accuracy.

According to another aspect of the present invention, when the tone signal is detected, the presence or absence of the tone signal is judged on the basis of the added value which results from adding the power value of the band whose power becomes maximum and the power values of the bands near the foregoing band and the added value which results from adding the power values of the whole bands of the sub-band powers. Therefore, it is possible to detect the single frequency tone signal by using the feature in which the ratio between the added value of the peak powers and the added value of the power values of the whole bands is increased when the input signal whose frequency spectrum is concentrated on the local portion is supplied to the signal discrimination circuit. Thus, it is possible to realize the signal discrimination circuit which can reliably classify various types of signals including tone signal into voice signal or voiceband data signal with a high accuracy.

According to another aspect of the present invention, when the tone signal is detected, the first peak power value is obtained by adding the power value of the frequency band whose power value becomes maximum and the power values of the frequency bands near the foregoing frequency bands. Also, the second peak power value is obtained by adding the power value of the frequency band whose power value becomes maximum in other different frequency band power values and the power values of the frequency band near the foregoing frequency band. Then, the presence or absence of the tone signal is detected in response to the ratio between the added value which results from adding these power values and the added value which results from the power values of the whole frequency bands of the sub-band powers. It is possible to reliably detect the single-frequency tone signal or the dual-frequency tone signal by using the feature in which the ratio between the added value of the peak powers and the added value of the power values of the whole frequency bands is increased when the input signal, such as the single-frequency tone signal or the dual-frequency tone signal whose frequency spectrum is concentrated on the local portion is supplied to the signal discrimination circuit. Thus, it is possible to realize the signal discrimination circuit which can reliably classify various types of signals including tone signal into voice signal or voiceband data signal with a high accuracy.

According to a further aspect of the present invention, when the tone signal is detected, the mean value of the frequency spectrum distribution of the input signal is calculated as the center frequency from the power values of the sub-bands. Also, this center frequency is held and the presence or absence of the tone signal is detected on the basis of the center frequency. Therefore, it is possible to reliably detect the single-frequency tone signal and the dual-frequency tone signal by using the feature in which the time fluctuation of the center frequency is decreased when the input frequency, such as the single-frequency tone signal or the dual-frequency tone signal whose frequency spectrum fluctuation is small is supplied to the signal discrimination circuit. Thus, it is possible to realize the signal discrimination circuit which can reliably classify various types of signals including tone signal into voice signal or voiceband data signal with a high accuracy.

According to a further aspect of the present invention, when the tone signal is detected, the sub-band powers are held and the presence or absence of the tone signal is judged in response to the difference between the sub-band powers thus held and the sub-band powers directly input. Thus, it is possible to detect the single-frequency tone signal and the dual-frequency tone signal by using the feature in which the difference is decreased when the input signal, such as the single-frequency tone signal or the dual-frequency tone signal whose frequency spectrum fluctuation is small is supplied to the signal discrimination circuit. Therefore, it is possible to realize the signal discrimination circuit which can reliably classify various types of signals including tone signal into voice signal or voiceband data signal with a high accuracy.

According to a further aspect of the present invention, when the tone signal is detected, the sub-band powers are held and the presence or absence of the tone signal is judged in response to the ratio between the sub-band powers thus held and sub-band powers directly input. Therefore, it is possible to detect the single-frequency tone signal and the dual-frequency tone signal by using the feature in which the difference is decreased when the input signal, such as the single-frequency tone signal or the dual-frequency tone signal whose frequency spectrum fluctuation is small is supplied to the signal discrimination circuit. Thus, it is possible to realize the signal discrimination circuit which can reliably classify various types of signals including tone signal into voice signal or voiceband data signal with a high accuracy.

According to a further aspect of the present invention, it is determined on the basis of the ratio between the output which results from adding only the power values of the low frequency bands of the sub-band powers and the output which results from adding the power values of the whole band of the sub-band powers. Therefore, it is possible to realize the signal discrimination circuit which can discriminate between the voice signal and the voiceband data signal by using the feature in which the ratio of the output which results from adding only the power values of the low frequency bands relative to the output which results from adding the power values of the whole frequency bands is increased when the input signal in which the power distribution is deviated in the low frequency band, such as the voice signal is supplied.

According to a further aspect of the present invention, in the voice/data discrimination unit, sub-band powers of the whole bands are added and the added output is held. Then, it is determined on the basis of the difference between the added value thus held and the added value which results from adding the respective band powers of the whole frequency bands whether the input signal is the voice signal or the voiceband data signal. An output of a difference calculation unit increases when the input signal, such as the voice signal whose power time fluctuation is large is supplied to the signal discrimination circuit. Thus, it is possible to realize the signal discrimination circuit which can discriminate between the voice signal and the voiceband data signal by comparing the output of the difference calculation unit with a certain threshold value.

Further, according to a yet further aspect of the present invention, in the voice/data discrimination unit, the added value which results from adding only the lower frequency of the sub-band powers and the added value which results from adding the power values of the whole frequency bands of the sub-band powers are calculated. Then, the added value which results from adding the power values of the whole frequency bands are held, and the difference between the added value thus held and the added value of the power values of the whole frequency bands is calculated. It is determined on the basis of the added value of the power values of the low frequency bands, the added value of the power values of the whole frequency bands and the difference whether the input signal is the voice signal or the voiceband data signal. Thus, it is possible to realize the signal discrimination circuit which can discriminate between the voice signal and the voiceband data signal with a higher accuracy by using the feature in which the ratio of the added value of the powers of the low frequency bands relative to the added value of the powers of the whole frequency bands is increased when the input signal, such as the voice signal whose power distribution is concentrated on the low frequency bands is supplied to the signal discrimination circuit and the feature in which the difference is increased when the input signal, such as the voice signal whose power time fluctuation is large is supplied to the signal discrimination circuit.

Furthermore, according to a still further aspect of the present invention, in the voice/data discrimination unit, there are selected a plurality of frequency bands of sub-band powers in which characteristics of the voice signal or the voiceband data signal become remarkable. Then, it is determined on the basis of these selected outputs whether the input signal is the voice signal or the voiceband data signal. Therefore, the voice/data discrimination processing is carried out by using the frequency bands typically representing the low frequency band, the middle frequency band and the high frequency band of the sub-band powers. Thus, it is possible to realize the signal discrimination circuit of the simple arrangement which can discriminate between the voice signal and the voiceband data signal with a higher accuracy.

What is claimed is:

1. A signal discrimination circuit comprising:

an electric power judgement unit for determining on the basis of an interblock electric power ratio whether an input signal is a voice signal or a voiceband data signal;

a zero-crossing number judgement unit for determining on the basis of a zero-crossing number whether said input signal is said voice signal or said voiceband data signal;

a sub-band power calculation unit for analyzing said input signal with a spectrum analyzer to generate a spectrum analyzed result and calculating sub-band powers using said spectrum analyzed result;

a tone detection unit for judging a presence and absence of a tone signal on the basis of the sub-band powers calculated by said sub-band power calculation unit; and a discriminated result output unit for determining on the basis of determined results of said electric power judgement unit, said zero-crossing number judgement unit, and an output from said tone detection unit whether said input is said voice signal or said voiceband data signal and outputting a judged result.

2. A signal discrimination circuit according to claim 1, further comprising a reset signal generation unit for receiving a signaling signal, detecting a call connection or a call disconnection on the basis of a state of said signaling signal, and generating a reset signal when said call connection or said call disconnection is detected, and wherein the judged result of the discriminated result output unit is said voice signal when said reset signal generation unit generates said reset signal.

3. A signal discrimination circuit according to claim 1, wherein said tone detection unit includes a 2100 Hz detection unit that compares a power value of a sub-band power having a frequency band closest to 2100 Hz and a predetermined threshold value, detects a presence of a 2100 Hz tone signal on the basis of said comparison, and wherein the judged result of the discriminated result output unit is said voiceband data signal when the presence of said 2100 Hz tone signal is detected.

4. A signal discrimination circuit according to claim 1, wherein each sub-band power of the sub-band powers has a power value and corresponds to a respective frequency band in a whole frequency band and said tone detection unit includes:

a peak frequency power addition unit for adding power values of the sub-band power corresponding to a frequency band in which the power value is a maximum and N sub-band powers corresponding to N frequency bands adjacent to said frequency band;

a whole band power addition unit for adding power values of the sub-band powers corresponding to the whole frequency band; and a judgement unit for calculating a ratio between an output of said peak frequency power addition unit and an output of said whole band power addition unit and judging the presence of said tone signal in response to said calculated ratio.

5. A signal discrimination circuit according to claim 1, wherein each sub-band power of the sub-band powers has a power value and corresponds to a respective frequency band in a whole frequency band and said tone detection unit includes:

a first peak frequency power addition unit for adding power values of the sub-band power corresponding to a first frequency band in which the power value is a maximum and N sub-band powers corresponding to N frequency bands adjacent to said first frequency band;

a peak frequency power zero mask unit for receiving the sub-band powers of said sub-band power calculation unit, forcing the power value of the sub-band power corresponding to the first frequency band to be set to a value "0", and outputting the forced sub-band power and remaining sub-band powers;

a second peak frequency power addition unit for receiving output of the peak frequency power zero mask unit and adding power values of the sub-band power corresponding to a second frequency band in which the power value of the remaining sub-band powers is a maximum and N remaining sub-band powers corresponding to N frequency bands adjacent to said second frequency band;

an adder for adding an output of said first peak frequency power addition unit and an output of said second peak frequency power addition unit;

a whole band power addition unit for adding power values of the sub-band powers corresponding to the whole frequency band; and a judgement unit for calculating a ratio between an output of said adder and an output of said whole band power addition unit and determining the presence said tone signal in response to said calculated ratio.

6. A signal discrimination circuit according to claim 1, wherein said tone detection unit includes:

a center frequency calculation unit for calculating a mean value of the input signal frequency spectrum distribution from the sub-band powers calculated by said sub-band power calculation unit;

a delay buffer for holding first output of said center frequency calculation unit; and a judgement unit for judging the presence of said tone signal on the basis of second output of said center frequency calculation unit and an output of said delay buffer.

7. A signal discrimination circuit according to claim 1, wherein said tone detection unit includes:

a delay buffer for holding a first of the sub-band powers calculated by said sub-band power calculation unit;

a difference calculation unit for calculating a difference between a second of the sub-band powers calculated by said sub-band power calculation unit and an output of said delay buffer; and a judgement unit for judging the presence of said tone signal on the basis of said difference calculation unit.

8. A signal discrimination circuit according to claim 1, wherein said tone detection unit includes:

a delay buffer for holding a first of the sub-band powers calculated by said sub-band power calculation unit;

a divider for calculating a ratio between a second of the sub-band powers calculated by said sub-band power calculation unit and an output of said delay buffer; and a judgement unit for judging the presence of said tone signal on the basis of an output from said divider.

9. A signal discrimination circuit comprising:

a sub-band power calculation unit for analyzing an input signal with a spectrum analyzer to generate spectrum analyzed result and calculating sub-band powers using said spectrum analyzed result;

a tone detection unit for judging a presence of a tone signal from the sub-band powers calculated by said sub-band power calculation unit;

a voice/data discrimination unit for determining on the basis of the sub-band powers calculated by said sub-band power calculation unit whether said input signal is a voice signal or a voiceband data signal; and a discriminated result output unit for determining on the basis of a judged result of said tone detection unit and a determined result of said voice/data discrimination unit whether said input signal is said voice signal or said voiceband data signal and outputting a discriminated result.

10. A signal discrimination circuit according to claim 9, further comprising a reset signal generation unit for receiving a signaling signal, detecting a call connection or a call disconnection on the basis of a state of said signaling signal and generating a reset signal when said call connection or said call disconnection is detected and wherein the discriminated result is said voice signal when said reset signal generation unit generates said reset signal.

11. A signal discrimination circuit according to claim 9, wherein said tone detection unit includes a 2100 Hz detection unit that compares a power value of a sub-band power having a frequency band closest to 2100 Hz and a predetermined threshold value, detects a presence of a 2100 Hz tone signal on the basis of said comparison, and wherein the discriminated result is said voiceband data signal when the presence of said 2100 Hz tone signal is detected.

12. A signal discrimination circuit according to claim 9, wherein each sub-band power of the sub-band powers has a power value and corresponds to a respective frequency band in a whole frequency band and said tone detection unit includes:

a peak frequency power addition unit for adding power values of the sub-band power corresponding to a frequency band in which the power value is a maximum and N sub-band powers corresponding to N frequency bands adjacent to said frequency band;

a whole band power addition unit for adding power values of the sub-band powers corresponding to the whole frequency band; and a judgement unit for calculating a ratio between an output of said peak frequency power addition unit and an output of said whole band power addition unit and judging the presence of said tone signal in response to said calculated ratio.

13. A signal discrimination circuit according to claim 9, wherein each sub-band power of the sub-band powers has a power value and corresponds to a respective frequency band in a whole frequency band and said tone detection unit includes:

a first peak frequency power addition unit for adding power values of the sub-band power corresponding to a first frequency band in which the power value is a maximum and N sub-band powers corresponding to N frequency bands adjacent to said first frequency band;

a peak frequency power zero mask unit for receiving the sub-band powers of said sub-band power calculation unit, forcing the power value of the sub-band power corresponding to the first frequency band to be set to a value "0", and outputting the forced sub-band power and remaining sub-band powers;

a second peak frequency power addition unit for receiving output of the peak frequency power zero mask unit and adding power values of the sub-band power corresponding to a second frequency band in which the power value of the remaining sub-band powers is a maximum and N remaining sub-band powers corresponding to N frequency bands adjacent to said second frequency band;

an adder for adding an output of said first peak frequency power addition unit and an output of said second peak frequency power addition unit;

a whole band power addition unit for adding power values of the sub-band powers corresponding to the whole frequency band; and a judgement unit for calculating a ratio between an output of said adder and an output of said whole band power addition unit and determining the presence of said tone signal in response to said calculated ratio.

14. A signal discrimination circuit according to claim 9, wherein said tone detection unit includes:

a center frequency calculation unit for calculating a mean value of the input signal frequency spectrum distribution from the sub-band powers calculated by said sub-band power calculation unit;

a delay buffer for holding first output of said center frequency calculation unit; and a judgement unit for judging the presence of said tone signal on the basis of second output of said center frequency calculation unit and an output of said delay buffer.

15. A signal discrimination circuit according to claim 9, wherein said tone detection unit includes:

a delay buffer for holding a first of the sub-band powers calculated by said sub-band power calculation unit;

a difference calculation unit for calculating a difference between a second of the sub-band powers calculated by said sub-band power calculation unit and an output of said delay buffer; and a judgement unit for judging the presence of said tone signal on the basis of said difference calculation unit.

16. A signal discrimination circuit according to claim 9, wherein said tone detection unit includes:

a delay buffer for holding a first of the sub-band powers calculated by said sub-band power calculation unit;

a divider for calculating a ratio between a second of the sub-band powers calculated by said sub-band power calculation unit and an output of said delay buffer; and a judgement unit for judging the presence of said tone signal on the basis of an output from said divider.

17. A signal discrimination circuit according to claim 9, wherein each sub-band power of the sub-band powers has a power value and corresponds to a respective frequency band in a whole frequency band and said voice/data discrimination unit includes:

a low frequency power addition unit for adding only power values of sub-band powers that correspond to low frequency bands calculated by said sub-band power calculation unit;

a whole band power addition unit for adding power values of the sub-band powers that correspond to the whole frequency band output from calculated by said sub-band power calculation unit; and a judgement unit for calculating a ratio between an output of said low frequency power addition unit and an output of said whole band power addition unit and determining on the basis of said calculated ratio whether said input signal is said voice signal or said voiceband data signal.

18. A signal discrimination circuit according to claim 9, wherein each sub-band power of the sub-band powers has a power value and corresponds to a respective frequency band in a whole frequency band and said voice/data discrimination unit includes:

a whole band power addition unit for adding power values of the sub-band powers that correspond to the whole frequency band calculated by said sub-band power calculation unit;

a delay buffer for holding a first output of said whole band power addition unit;

a difference calculation unit for calculating a difference between a second output of said whole band power addition unit and an output of said delay buffer; and a judgement unit for determining on the basis of an output of said difference calculation unit whether said input signal is said voice signal or said voiceband data signal.

19. A signal discrimination circuit according to claim 9, wherein each sub-band power of the sub-band powers has a power value and corresponds to a respective frequency band in a whole frequency band and said voice/data discrimination unit includes:

a low frequency power addition unit for adding only power values of sub-band powers that correspond to low frequency bands calculated by said sub-band power calculation unit;

a whole band power addition unit for adding power values of the sub-band powers that correspond to the whole frequency band calculated by said sub-band power calculation unit;

a delay buffer for holding a first output of said whole band power addition unit;

a difference calculation unit for calculating a difference between a second output of said whole band power addition unit and an output of said delay buffer; and a judgement unit for determining on the basis of an output of said low frequency power addition unit, said second output of said whole band power addition unit and an output of said difference calculation unit whether said input signal is said voice signal or said voiceband data signal.

20. A signal discrimination circuit according to claim 9, wherein each sub-band power of the sub-band powers has a power value and corresponds to a respective frequency band and said voice/data discrimination unit includes:

a sub-band power decimation unit for selecting a plurality of frequency bands in which the power value of the sub-band power corresponding to each respective frequency band of the plurality of frequency band detectably differs when the input signal is the voice signal and when the input signal is the voiceband data signal, the sub-band power decimation unit outputting power values of the sub-band power corresponding to said selected frequency bands; and a judgement unit for determining on the basis of an output of said sub-band power decimation unit whether said input signal is a voice signal or a voiceband data signal.

21. The signal discrimination circuit of claim 1, wherein the judged result of the discriminated result output unit is determined to be said voice signal when the tone detection unit detects the presence of the tone signal.

* * * * *

UNITED STATES PATENT AND TRADEMARK OFFICE

CERTIFICATE OF CORRECTION

PATENT NO. : 5,694,517

DATED : December 2, 1997

INVENTOR(S): Yukimasa Sugino and Yushi Naito

It is certified that error appears in the above-identified patent and that said Letters Patent is hereby corrected as shown below:

At column 1, line 23, before "channel assignment" insert -- a --.
At column 1, line 66, after "then", change "a" to -- an --.
At column 2, line 5 change "an voice" to -- the voice --.
At column 2, line 16 change "encoding speed" to -- encoding bit rate --.
At column 2, line 28, change "A-low" to -- A-law --.
At column 2, line 49, change "an voice" to -- a voice --.
At column 3, line 56, change "unit 6" to -- unit 3 --.
At column 6, line 39, change "an voice/data" to -- a voice/data --.
At column 11, line 21, change "provided a FET" to -- provided an FET --.
At column 11, line 22, change "a FFT" to -- an FFT --.
At column 13, line 16, change "the frequency band width" to -- the sampling frequency --.
At column 14, line 53, change "present or absence" to -- presence or absent --.
At column 14, line 55, change "present of tone signal" to -- presence of tone signal --.
At column 16, line 14, after "signal lines S21-0 to S21-(n-1)", insert -- and S30-0 to S30-(n-1) --.
At column 16, line 52, change "the whole power addition unit" to -- the whole band power addition unit --.
At column 20, line 63, change "an voice signal or an voice band data signal" to -- the voice signal or the voiceband data signal --.
At column 21, line 2 change "reset signal generating unit" to -- reset signal generation unit --.
At column 21, lines 36 and 39, change "hung-up signal" to -- hang-up signal --.
At column 22, lines 7, 33, 34, 61,66, and 67, change "generating" to -- generation --.
At column 23, lines 1, 7, and 9, change "generating" to -- generation --.
At column 23, line 23 change "signal discriminated output S11" to -- discriminated result output unit 121--.
At column 27, line 54, change "data band data" to -- voice band data --.
At column 29, line 60 change "output S35" to -- output S36 --.
At column 32, line 56 change "lower frequency" to -- low frequency --.
At column 33, line 61, change "decision unit 114" to -- judgment unit 114 --.

UNITED STATES PATENT AND TRADEMARK OFFICE

CERTIFICATE OF CORRECTION

PATENT NO. : 5,694,517

DATED : December 2, 1997

INVENTOR(S) : Yukimasa Sugino and Yushi Naito

It is certified that error appears in the above-indentified patent and that said Letters Patent is hereby corrected as shown below:

At column 39, lines 49-50, change "presence said tone signal" to -- presence of said tone signal --.

Signed and Sealed this

Fourteenth Day of July, 1998

Bruce Lehman

*Attest:*

BRUCE LEHMAN

*Attesting Officer*

*Commissioner of Patents and Trademarks*